US007472859B2

(12) United States Patent
McMahan

(10) Patent No.: US 7,472,859 B2
(45) Date of Patent: Jan. 6, 2009

(54) POWERED SERVING WINDER APPARATUS FOR MANUFACTURING BOWSTRING

(76) Inventor: Philip Gerald McMahan, 34 Cheyenne Dr., Chilicothe, OH (US) 45601

( * ) Notice: Subject to any disclaimer, the term of this patent is extended or adjusted under 35 U.S.C. 154(b) by 0 days.

(21) Appl. No.: 11/796,436

(22) Filed: Apr. 27, 2007

(65) Prior Publication Data

US 2007/0278339 A1 Dec. 6, 2007

Related U.S. Application Data

(60) Provisional application No. 60/795,433, filed on Apr. 27, 2006.

(51) Int. Cl.
*B21F 3/04* (2006.01)

(52) U.S. Cl. ..... 242/437; 242/438.1; 242/448; 57/1 R

(58) Field of Classification Search ..... 242/436, 242/437, 438.1, 439.2, 441.2, 441.4, 448, 242/448.1; 57/1 R
See application file for complete search history.

(56) References Cited

U.S. PATENT DOCUMENTS

| | | | | |
|---|---|---|---|---|
| 2,906,086 | A * | 9/1959 | Wilson et al. | 57/1 R |
| 3,616,061 | A * | 10/1971 | Carter | 156/431 |
| 4,982,560 | A * | 1/1991 | Vives et al. | 242/439 |
| 6,401,442 | B1 * | 6/2002 | Root et al. | 57/27 |
| 2004/0046079 | A1 * | 3/2004 | Coy | 242/439.3 |

* cited by examiner

*Primary Examiner*—Emmanuel M Marcelo
(74) *Attorney, Agent, or Firm*—Mueller Smith

(57) ABSTRACT

The invention comprises a portable apparatus for the manufacture of bowstrings that facilitates application of bowstring serving cord when producing new custom built archery bowstrings, particularly for compound bows. The invention provides a power driveable device for rotating and advancing a serving tool utilizing a winder head that is pivotable and stowable to allow use of a bowstring jig without interference from the winder power head when not needed and then pivoting the power head into a drive position when serving is to be wound around the bowstring. The power serving winder also provides for serving from both ends of a bowstring without remounting the string on a jig apparatus, and for applying tension to the bowstring while being manufactured.

11 Claims, 13 Drawing Sheets

POWERED SERVING WINDER APPARATUS FOR MANUFACTURING BOWSTRING

CROSS-REFERENCE TO RELATED APPLICATIONS

This application is a continuation in part of U.S. application, Ser. No. 60/795,433 filed Apr. 27, 2006.

STATEMENT REGARDING FEDERALLY SPONSORED RESEARCH

Not applicable.

BACKGROUND OF THE INVENTION

The present invention generally relates to an improved system, method and apparatus for the manufacture of custom archery bowstrings.

The use of a flexed bow to propel an arrow towards a target dates to ancient times. The bowstring of a bow can be constructed of a wide variety of synthetic and natural fibers. Desired qualities for bowstrings are that the bowstring have high strength and limited elongation under tension, be durable, and respond predictably to the release of the drawn bow by the archer.

Archery bows are available in a wide variety of forms. Such forms include a longbow constructed of solid wood, such as yew, hickory or ash. An improvement of the longbow is the recurve bow, typically constructed of laminated wood, fiberglass or a combination of those or similar materials. FIG. 1 shows a diagram of a recurve archery bow, 40, strung with bowstring 42, with the bowstring ends 44 looped around the two bow arms or limbs 46, which are connected by grip handle 48. The longbow and recurve bow can be utilized with the bow and bowstring held in a vertical orientation, and the arm and fingers of the archer are used to draw the bow and release the drawn bowstring. The crossbow, an ancient variation of the longbow, in its modern form is often built with a recurved bow and attached bowstring held horizontally in a mount that allows the bow to be drawn and held in the drawn position. The crossbow can then be released at the archer's discretion using a mechanical release mechanism.

To preserve the elasticity of the bow, bows are usually stored with the string relaxed or unstrung. The simple bow, following ancient design, has a single bowstring that is either looped around the ends of limbs of the bow, looped around one end, and tied to the other limb, or tied to both limbs.

Archery technology departed from more than 2000 years of tradition with the invention by Allen of 'An archery bow with drawforce multiplying attachment," as described in U.S. Pat. No. 3,486,495, issued Dec. 30, 1969. The Allen bow is commonly called a "compound bow." The compound bows sold today usually closely resemble the Allen bows, with a pair of eccentric cams mounted near the tips of the two limbs of the bow, with the bowstring wrapped around the each rotating cam and connected such that drawing the bowstring rotates the bowstring about the eccentric of each cam. The cams may also then be connected to a load cable that extends from the cam to an anchor on the tip of the opposite bow limb. This configuration provides for variable leverage exerted by the load cables while bending the bow limbs, such that the force required to hold the fully drawn bowstring is less than the maximum force required while the drawing of the bowstring. After 1969 the compound bow became increasingly popular, such that by the year 1980 the majority of bows and crossbows sold were compound bows. FIG. 2 shows a diagram of a typical compound archery bow, 50, strung with compound bowstring 52. Compound bowstring 52, beginning with ends 54, passes over pulleys 55 and 56 before reaching an attachment at the end of one of limbs 57, which are supported by grip handle 58.

Two forms of bowstrings are commonly used with simple bow, the continuous bowstring, and the Flemish bowstring. The Flemish bowstring has a loop at one end, and a free end (for tying) at the other. In certain applications, a number of individual strings are attached end to end to provide sufficient length, and to allow replacement of worn portions.

The so-called continuous bowstring is formed of an elongated length of bowstring body fiber that is used to form a loop of bowstring fiber, then end loops are formed by wrapping a portion of the bowstring body fiber with serving fiber in order to form a loop and add protection to the end loops which are areas of high wear. The typical compound bow has two to three bowstrings. If these bowstrings were a single bowstring, the single bowstring would typically be three times as long as the string for a recurve bow of similar size.

The manufacture of bowstrings is in part difficult because the length of bowstring needed varies substantially between different models of bows, and the type of bowstring may vary for different applications, relating to drawforce, and the sport in which the bow is used. Thus, archery practitioners rely on the manufacture of a wide variety of slightly different bowstrings, often times relying on their own skills to manufacture a needed bowstring, or being forced to wait through long delivery periods while a custom bowstring is delivered. Archery shops are unable to stock the enormous number of different bowstrings that would be needed to service all bows available to archers, thus rarely hold in stock more than the most common bowstrings. As a service to their customers, certain archery shops have become skilled at the custom construction of bowstrings. To this day, almost all construction of bowstrings at local shops is by hand winding of serving cord around bowstring fibers, often on a one of a kind jig. There exists the continuing need for a machine that could speed the rate at which bowstrings can be manufactured and that allows for the custom manufacture of bowstrings that meet individualized needs in terms of size, twist rate, materials and weight.

A number of previous types of apparatus contain elements that may be useful in the manufacture of bowstrings. For instance, U.S. Pat. No 3,616,061 to J. W. Carter, issued Oct. 26, 1971 discloses a powered apparatus that traverses along two axes and winds one elongated material over a second elongated material that is stationery during winding. This apparatus provides spools that rotate around a core, with longitudinal displacement controlled by pulley system. U.S. Pat. No 3,882,662 discloses a bowstring server that wraps along a bowstring. U.S. Pat. No. 4,013,500 discloses an apparatus for wrapping flower stems. U.S. Pat. No 4,663,928 to Delobel, et al, issued May 12, 1987 discloses a machine for winding single strands of protective wire over a multiple stranded core. The machine is adapted for wrapping a cable that moves though the winding head, and is not adaptable for wrapping a fixed cable at several optional locations along its length. U.S. Pat. No. 4,824,036 discloses an apparatus for spiral winding of strands of hair.

A number of types of apparatus that would be adaptable to wrapping serving cord around a bowstring are typified by U.S. Pat. No. 6,401,442 to Root, et al., issued Jun. 11, 2002, disclosing an apparatus for dubbing or wrapping fly body material around a hook during assembly in fly hook production. The fibers forming the body of the wrapped body are rotated around one fixed end. Other apparatus could rotate the entire boy fibers relative to serving cord. Systems such as this suffer from limitations in maintaining finished length, as is needed in bowstrings, and variation in the relative twist of the fibers.

U.S. Pat. No. 5,538,197 to Killian, issued Jul. 23, 1996 shows one portable power driven serving apparatus known in the art. The apparatus provides a gear driven serving tool that is latched around a bowstring, activated to wrap serving, essentially as a hand serving tool would do, and the unlatched and moved to another position. A similar device is disclosed in U.S. Patent Publication No 2004/0046079 by Coy, that discloses a bowstring serving tool with a dedicated power source that is hand held. In the Coy device, a slotted disk carrying a serving tool is rotated about a center point by motor driven bevel gears. No provision is made to assure proper indexing of serving cord and regularity of applied serving.

Thus no available apparatus provides an integrated machine capable of uniformly, and efficiently applying serving around a fiber bundle. There exists a continuing need for such an apparatus that allows for the rapid construction of bowstrings of a desired length and with performance characteristics of predictable quality.

BRIEF SUMMARY OF THE INVENTION

The present invention provides a portable machine that facilitates winding of bowstring serving material when producing new custom built archery bowstrings, particularly for compound bows. The invention provides a power driveable device for powering and advancing a serving winder head that is pivotable and stowable. The power serving winder provides for serving from both ends of a bowstring without remounting the string on a jig apparatus.

The present invention provides an apparatus for the manufacture of bowstrings comprising a bowstring jig; a serving tool positionable in a coaxial manner with a bowstring mounted on the bowstring jig, a rotatable, serving winder for rotating the serving tool about the stationary bowstring, wherein the serving winder advances the serving tool along the bowstring while rotating the serving tool.

The present invention provides a serving apparatus comprising a serving tool head, a drive system for rotating said serving tool head and one or more serving tool guides allowing for guiding the coaxial longitudinal travel of a serving tool along a bowstring. A further embodiment is a serving winder for the application of serving cord to a cable comprising a base with pivots, a drive shaft essentially coaxial with said pivots, said driveshaft connected to a drive pulley, with the drive pulley connected to an idler pulley, said idler pulley connected to a guide shaft with a guide shaft passage, such that when rotational force is applied to the drive shaft, a serving head attached to the end of the guide shaft is rotated about an axis essentially coaxial with the guide shaft passage.

The invention is further embodied in a bowstring jig comprising a wrapping yoke with two or more wrapping posts disposed along a post bar, with the post bar positionable along a jig bar and lockable in place, an adjustable tensioner assembly is further provided for application of uniform tension to a tensioner post, with the tensioner assembly being positionable along a jig bar and lockable in place by a tensioner lock. Thus, bowstring body fiber may be wrapped around the wrapping posts along with the tensioner post and tension may be applied to the bowstring body fiber while a bowstring is under construction on the new jig.

Yet another embodiment if the invention is a bowstring manufactured while utilizing the apparatus of the invention.

BRIEF DESCRIPTION OF THE DRAWINGS

For a fuller understanding of the nature and advantages of the present invention, reference should be had to the following detailed description taken in connection with the accompanying drawings, in which.

DETAILED DESCRIPTION OF THE INVENTION

The invention provides for a new method, system and apparatus for constructing a string or cable of multiple fibers serve wound into a bundle. A preferred embodiment is use of the method, system and apparatus to construct bowstrings for the archery trade using a machine constructed according to the embodiments disclosed herein. A particularly preferred embodiment is a continuous bowstring adaptable for use with simple, recurved or compound archery bows. A decided advantage over any existing apparatus of the manufacture of bowstrings in particular is the ability to wrap serving using a powered apparatus around the extended axis of a fixed bundle of fibers that are held in position and under proper tension with a given twist factor applied. Thus a further embodiment is a system, method and apparatus for the manufacture or bowstring with predictable, reproducible performance characteristics in a rapid and/or efficient manner.

Figure 1:
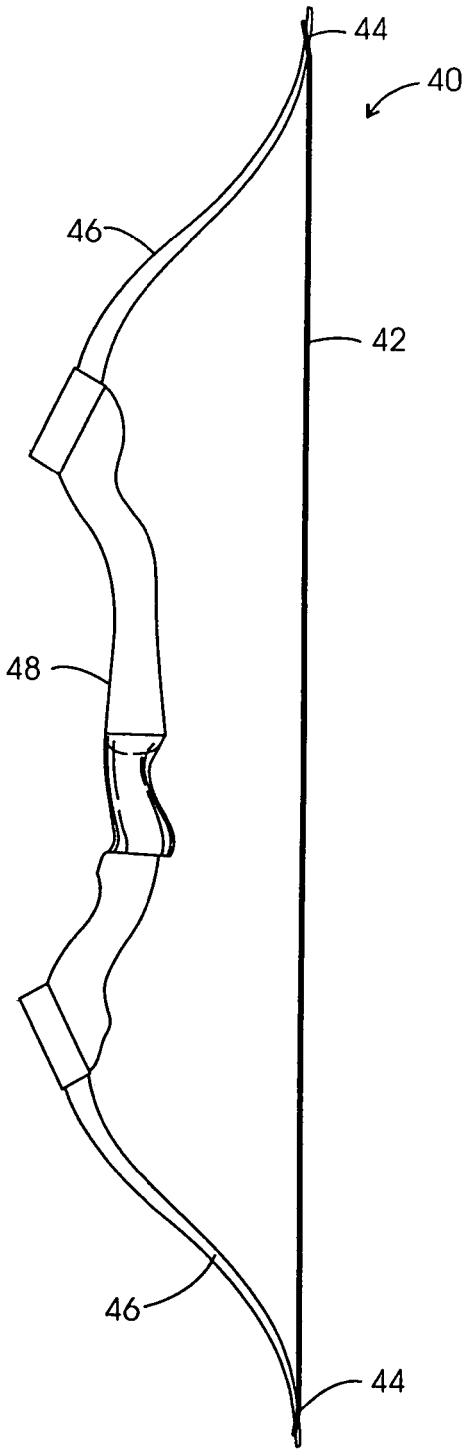
FIG. 1 PRIOR ART
FIG. 1 shows a diagram of a recurve archery bow.
Figure 2:
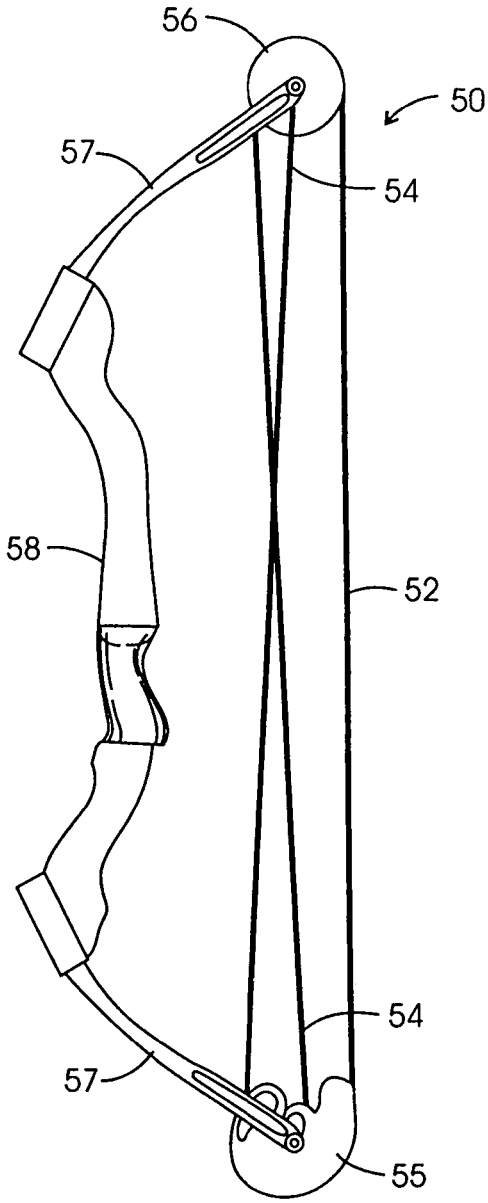
FIG. 2 PRIOR ART
FIG. 2 shows a diagram of a typical compound archery bow.
Figure 3:
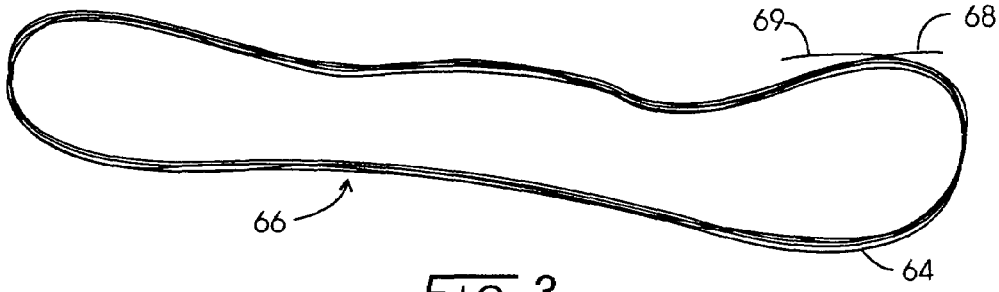
FIG. 3 PRIOR ART
FIG. 3 shows a loop of bowstring body fiber.

The invention is particularly useful for use in the manufacture of continuous bowstrings. A continuous bowstring is constructed of a single continuous length of bowstring body fiber. As shown in FIG. 3, the length of bowstring body fiber 64 is positioned into a circular loop 66 of bowstring fiber, formed of, for example 5, 10 or 20 loops of bowstring body fiber 64. In this manner the continuous bowstring will typically have only two free ends, 68 and 69. Said bowstring body fiber free ends can be fixed by glues, bowstring serving, heat sealing, or other means known to bowstring artisans. The bowstring serving material is a small diameter string or cord that is wrapped around the bowstring body fibers holding them in a given position, for instance, to form loops at the end of the bowstring and/or to protect parts of the bowstring subject to wear (e.g., the area where an arrow is nocked on the bowstring).

Figure 4:
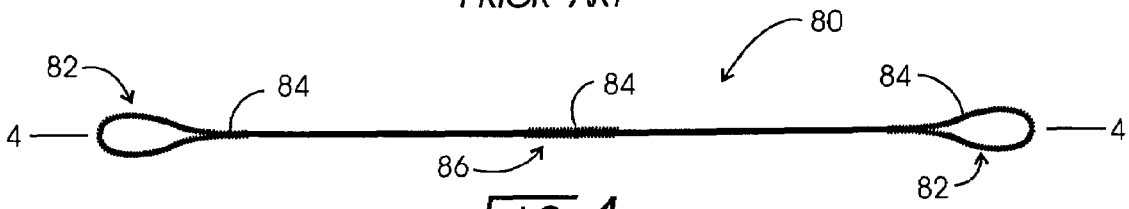
FIG. 4 PRIOR ART
FIG. 4 shows a diagram of a finished bowstring.
Figure 5:
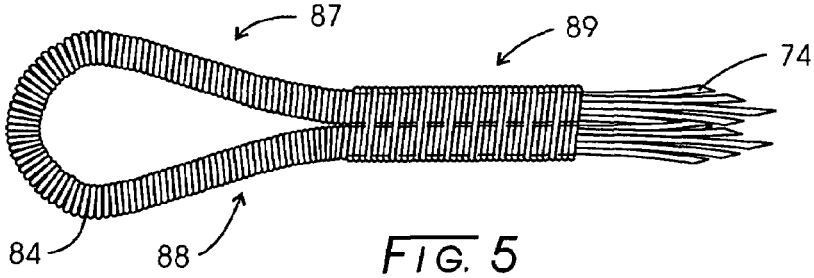
FIG. 5 PRIOR ART
FIG. 5 shows a detail of the end loop of a continuous bowstring.
Figure 6:
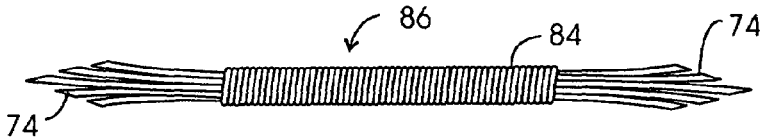
FIG. 6 PRIOR ART
FIG. 6 shows a detail of intermediate serving.

FIG. 4 shows a view of a completed bowstring, 80, with two loop ends 82, in which bowstring serving 84 is applied to form the two bowstring loop ends 82, and nock serving 86. FIG. 5 shows a detail of one such bowstring loop end 87. Bowstring serving 84 is wrapped around bowstring body fiber 74, typically in a spiral arrangement, thus holding bowstring body fiber 74 in position within a bundle. Bowstring loop serving 88 is first applied to the portion of the bowstring that will form loop end 87, then end serving 89 is applied either over, or adjacent to loop serving 88, thus forming a completed and fixed bowstring loop end 87. As shown in FIG. 6, serving 84 may be applied at any position on the bowstring fiber, including at an intermediate position such as for nock serving 86. Nock serving 86 protects and holds into position bowstring body fibers 74 in the area where an arrow is nocked on the bowstring when used for archery. It should be recognized that intermediate serving, such as nock serving 86 may be optionally applied to the bowstring body fibers at any location along the length of the bowstring where it is desired, such as at position of high wear potential, such as, for instance, where the bowstring passes over cam pulleys of a compound bow.

Figure 7:
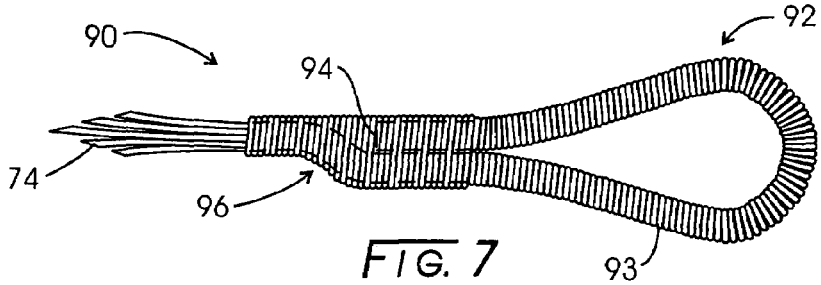
FIG. 7 PRIOR ART
FIG. 7 shows a detail of the end loop of a linear bowstring.

Turning briefly to FIG. 7, serving material may also be required or otherwise utilized to form the ends of a linear or Flemish style bowstring. FIG. 7 shows a loop formed along the end of a linear bowstring 90, wherein bowstring body fiber 74 is turned back upon itself, forming end loop 92, with serving 84 forming end loop serving 93 and wrapping around the free ends of body fiber 74 at 94, and being held in place by end serving 96.

Figure 8:
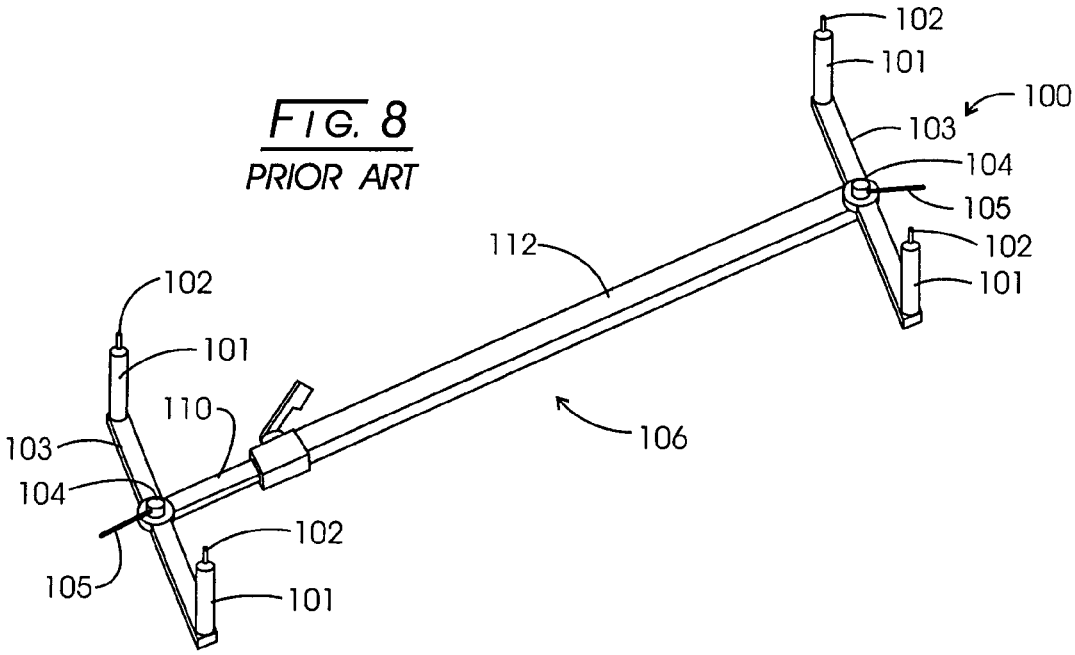
FIG. 8 PRIOR ART
FIG. 8 shows a perspective view of typical manual bowstring jig.

The invention is embodied in a jig tensioner assembly and serving spool drive mechanism that can be utilized with a number of existing bowstring manufacturing jigs, or with a jig adapted specifically for use with the inventive method. A bowstring is typically manufactured on a simple jig, such as jig 100 as shown in perspective view in FIG. 8. Most bowstring jigs have either three or four wrapping posts 101, as shown in FIG. 8 with four posts 101, with a wrapping post pin 102 inserted into the end of wrapping post 101. Wrapping posts 101 can optionally be attached to post bar 103, or jig bar 106. As shown in FIG. 8, wrapping posts 102 are attached to post bar 103, pivoting about post bar pivot 104, and being lockable by use of post bar lock 105. As shown in FIG. 8, post bars 103 are positioned in a perpendicular orientation with jig bar 106. Because the post bar 103 is pivotable about pivot 104, one or more of the post bars may optionally be positioned collinearly with jig bar 106, and are shown in the colinear orientation in FIG. 9.

Figure 9:
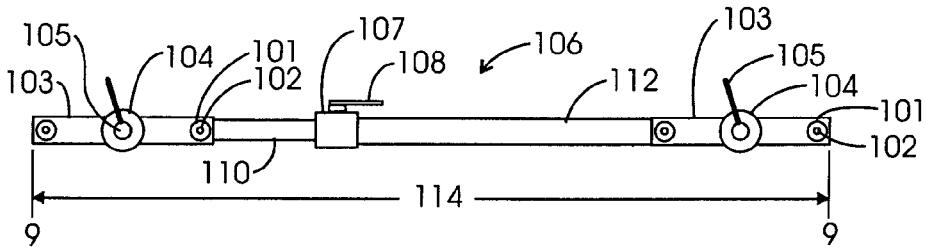
FIG. 9 PRIOR ART
FIG. 9 shows a plan view of typical manual bowstring jig.

In the type of jig as at 100 shown in FIG. 8 and FIG. 9, the length of the jig along jig bar 106 can be adjusted by telescoping jig bar 106 using locking collar 107, and jig bar lock 108 to determine the temporarily fixed length of jig bar 106 by telescoping inner jig bar 110 inside outer jig bar 112. Other existing jigs use spaced apart holes and pegs or locking slide channels, for instance, to position wrapping posts along a spaced apart distance, or along a jug bar as at 106. Turning to FIG. 9, a top view of jig 100 is shown, with post bars 103 rotated 90 degrees relative to as shown in FIG. 8, thus jig post 102 are positioned coaxially along the extended axis of jig bar 106. As shown in FIG. 9, the distance 114 along line 9-9 between two distally opposed wrapping posts 102 can be optionally varied by altering the length of jig bar 106 (i.e. the relative positions of wrapping posts) in order to build different length bowstrings. As will be seen, the distance 114 determines the length of the bowstring.

When building a continuous bowstring, the primary bowstring body is built up from multiple strands of a fiber cord such as Dacron or Kevlar, i.e. bowstring body fiber, by wrapping 10-20 loops of cord around the wrapping posts 102 of jig 100, when positioned as shown in FIG. 8, forming a continuous loop of bowstring as shown in FIG. 3. Bowstring body fiber cord is available from a wide variety of sources, for instance, Dacron B50 ™ and Kevlar ™ are supplied by Brownell & Co. of Moodus, Conn. Bowstring body fiber may be of a variety of weights, compositions, and colors.

As shown in FIG. 6, for instance, a small diameter serving cord or string material is wrapped around the bowstring body fibers, serving to hold the bowstring body in place and maintain form. Thus, the process of application of serving material to a bowstring body is typically labor intensive, time consuming and subject to operator error and manufacturing variation. Large operations are believed to wrap serving by rotating the bowstring in relation to a stationary serving string spool. Thus, in high production factories for the manufacture of bowstrings, most often the serving is applied to bowstring body fibers by rotating on a spindle the bowstring body fibers, and holding the serving fiber material supply bobbin in a fixed position. Artisans of custom string manufacture will typically use a serving tool with a rotating bobbin and serving string material supply spool that is rotated about the extended axis of the bowstring to apply serving to a stationary bundle of bowstring body fibers. Almost all custom bowstrings are thus essentially handmade.

Serving material is available in a wide variety of types, diameters, and colors. Several examples of serving string material, i.e. serving cord, include braided nylon, monofilament and proprietary serving string such as "Fast Flight" ™ and "Dyneema" ™. Again, serving material is available from a wide variety of sources, including from for instance, Brownell & Co. of Moodus, Conn.

Figure 10:
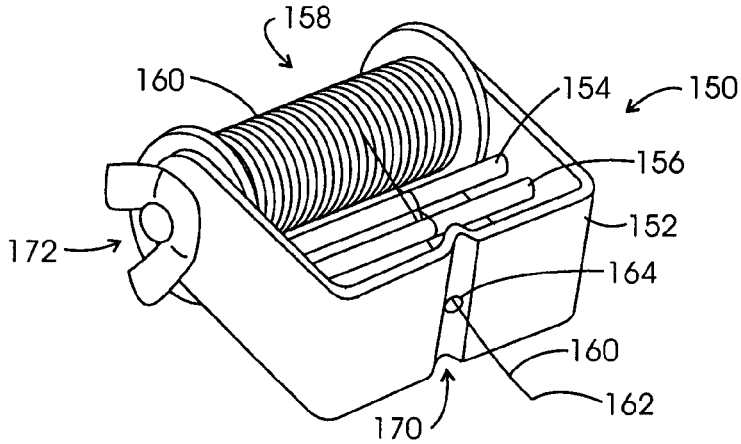
FIG. 10 PRIOR ART
FIG. 10 shows a perspective view of an existing serving tool of the "Cavalier" type.

A wide variety of serving tools with a rotating bobbin and serving string material supply spool are available from a variety of suppliers. With such serving tools providing one or more supply spools. Referring now to FIG. 10, a common and popular existing serving tool 150 of the type known as "Cavalier" ™ is shown. Cavalier tool 150 is formed from a frame 152, supporting tension rods 154 and 156, and a spool, serving supply bobbin 158, loaded with serving cord 160 wrapped around and or threaded about, and tensioned in part by tensioner rods 154 and 156. The free end 162 of the serving cord 160 on supply bobbin 158 passes through serving cord guide 164, which in the Cavalier type tool is positioned at the base of bowstring seat 170. Most commercial serving tools provides for adjusting the force required for rotating supply spool 158, such as by means of bobbin tensioner 172, and or by altering the position, size or composition of tensioner rods 154, 156. Those skilled in the art of archery string manufacture will recognize that a serving tool, and or a supply of serving cord to be applied to a bowstring under construction must preferably supply the means necessary for regulating the ease at which serving cord withdrawn from the supply bobbin, whether by controlling the rotation of the supply bobbin, tensioner rods, or other means.

Currently most custom strings are manufactured by manually wrapping serving around the bowstring body fibers held in a bowstring jig, such as jig 100, using a serving tool such as, for instance, the Cavalier type tool 150. As has been described herein, the tedious, manual, construction of a bowstring is little changed from the technology that has been utilized to construct bowstrings since ancient times. The primary differences are that modern bowstrings are typically built using bowstring body fiber and serving cord that is better adapted for use in bowstrings. Prior to the new apparatus and system disclosed here, there is only limited ability for reproducibly, rapidly and efficiently manufacturing a given desired bowstring. As stated, it is nearly impossible for merchants to stock bowstrings for more than the most common bows. Thus, archery merchants must special order bowstrings for their customers, with the attendant delays and potential for dissatisfaction with the special ordered product received. Those involved in archery are often forced to build their own bowstrings because of the difficulty in obtaining suitable commercial offerings.

The invention is embodied in a portable powered serving winder apparatus that allows individuals and merchants to quickly, efficiently, and reproducibly manufacture bowstrings in an on-demand basis. The invention allows merchants to provide for the availability of needed bowstrings without extended waits or excessive expense or difficulty. The compact nature of the new apparatus allows merchants to place the apparatus in crowded shops, or to transport the apparatus to remote locations, and to have the apparatus at the ready when a bowstring is needed or otherwise wasted downtime was available.

Figure 11:
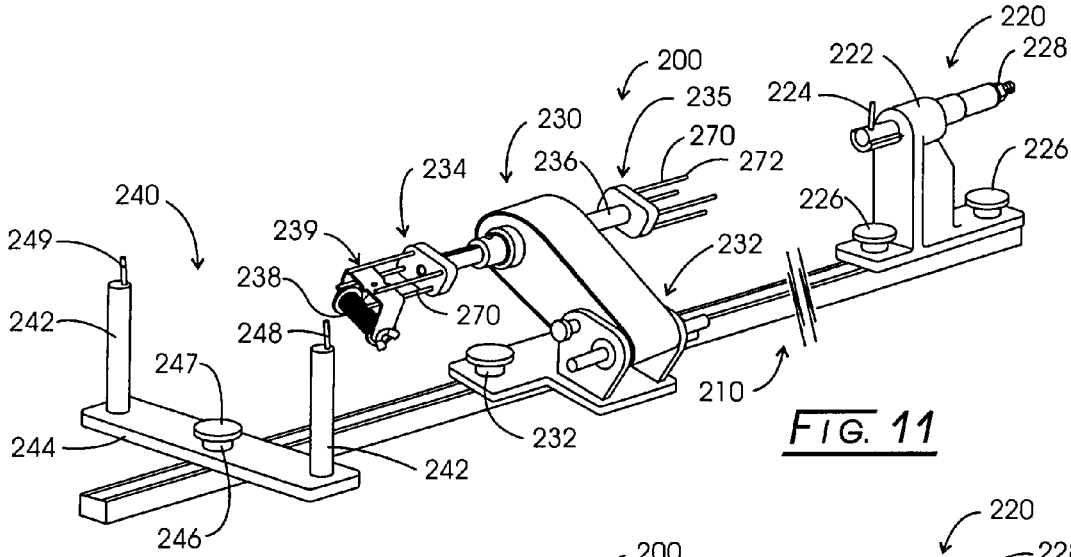
FIG. 11 shows a perspective view of a bowstring jig utilizing the powered serving winder apparatus.

FIG. 11 shows a perspective view of a bowstring jig 200 utilizing the powered serving winder apparatus 230 of the invention. In general, the embodied apparatus provides for an apparatus for the manufacture of bowstrings comprising a bowstring jig for mounting bowstring body fiber; a serving head for holding a serving cord supply allowing positioning of the serving cord supply spool carrying serving cord in a coaxial manner with the extended axis of the bowstring body fiber mounted on the bowstring jig. Powered serving winder apparatus 230 is a coaxial, rotatable, pivotable, powered serving winder for rotating the serving head coaxially about the extended axis of the bowstring body fiber; and the serving winder when pivoted from a stowed position into an active position, provides for rotating the serving head about the extended axis of the bowstring body fiber and drawing serving cord from the serving cord supply proceeding to wrap serving cord along the extended axis of the bowstring body fiber to apply the serving cord so that it is laid coaxially with the extended axis of the bowstring body fiber. Referring again briefly to FIG. 4, axis 4-4 defines an extended axis of a finished bowstring, which bowstring, except for the loops of bowstring body fiber at the ends 85 of the bowstring the bowstring body fiber is coaxial with axis 4-4. When serving cord is wrapped about the axis of the bowstring body fiber, as it extends along the bowstring, the extended wrapped serving cord is also coaxial with axis 4-4. The invention is also embodied in a provision for the serving winder advancing the serving cord supply spool along the extended axis of the bowstring body fiber while rotating a serving cord supply, a serving tool or other serving supply spool about the extended axis.

Bowstring jig 200 is comprised of jig bar 210, embodied in FIG. 11 as a channel, a tensioner assembly 220, a serving winder apparatus, 230, and wrapping yoke 240. Tensioner assembly 220 is composed of tensioner body 222, tensioner post 224, and is held in position along jig bar 210 by tensioner hold downs 226 at the opposed end of jig 200, and delivers tensional force by turning tensioner nut 228, through tensioner post 234.

As shown in FIG. 11 serving winder apparatus 230 is positionable at locations along jig bar 210. Winder 230 is optionally locked in a given position along jig bar 210 by one or more winder head locks 232. Winder 230, when activated, delivers power to rotate one or more serving heads, each with a provided serving cord supply, about the extended axis of the bowstring body fiber that is being used to build a bowstring. Winder 230, as embodied in FIG. 11, has two serving heads, embodied as paired serving tool adapters 234 and 235, and a serving cord supply 238 provided by a Cavalier type serving tool 239.

Figure 12:
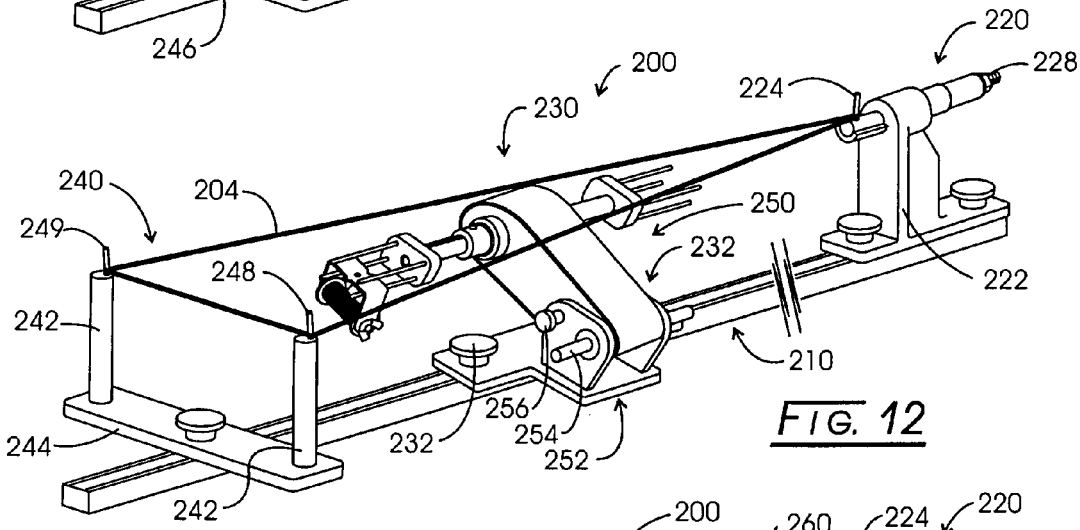
FIG. 12 shows a perspective view of a bowstring jig with a bowstring wrapped around the wrapping posts, and the powered serving head stowed.
Figure 13:
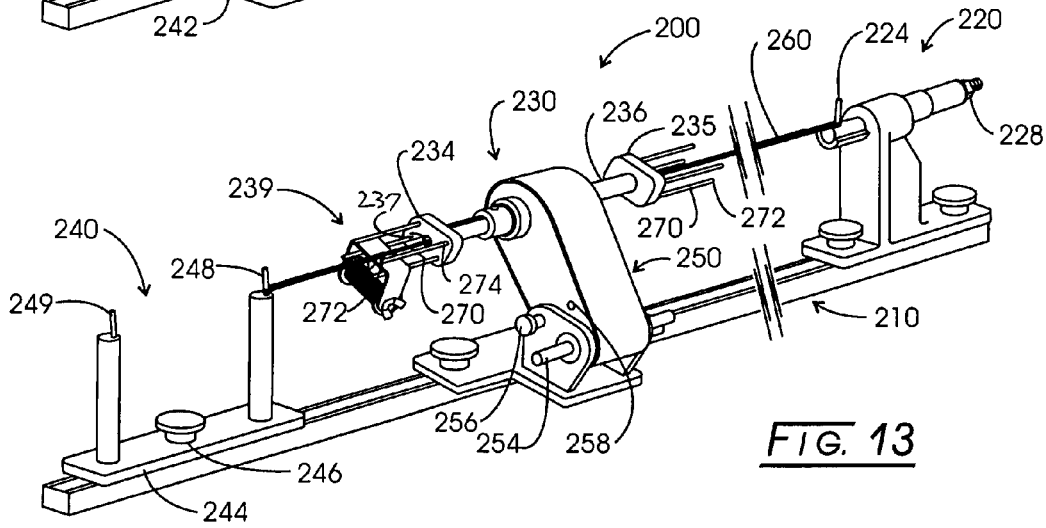
FIG. 13 shows a perspective view of a bowstring jig utilizing the powered serving winder apparatus.

Wrapping yoke 240, is embodied in wrapping posts 242 attached to yoke post bar 244. Wrapping posts 242 are attached to pivotable yoke post bar 244, pivoting about post bar pivot 246, and being lockable by use of post bar lock 247. Wrapping post pins 248 and 249 may be installed in the distal end of wrapping posts 242. The bowstring jig 200 in FIGS. 11-13 is shown with three wrapping posts, with two on wrapping yoke 240 and one on tensioner 220. As shown in FIG. 11, yoke post bar 244 is positioned in a perpendicular orientation relative to jig bar 210. Because the post bar 244 is pivotable about pivot 246, the yoke post bar 244 bearing wrapping posts 242 may optionally be positioned collinearly with the axis of jig bar 210.

As is apparent, jigs can be constructed with a variety of supports and of a variety of lengths according to the invention, so long as a system is provided to allow the system components to be slid or otherwise adjusted in parallel to the extended axis of the bowstring to be manufactured. For instance, a bar, a slotted table top, a table top with mounting holes or possibly a telescoping mechanism are adaptable for mounting the components and accomplishing the features of the apparatus as embodied herein.

FIG. 12 shows a perspective view of a bowstring jig 200 for utilizing the powered serving winder apparatus 230 of the invention. Bowstring body fiber 204 is looped around wrapping posts 242 at one end of jig 200, at tensioner post 224 at the opposed end of jig 200, and placed under tension by tensioner assembly 220, through tensioner post 224. Further details for tensioner assembly 220 are discussed in connection with FIG. 14, below. As can be seen in FIG. 12, the extended length of the bowstring body fiber 204 loop around the wrapping posts will be the primary determinate of final bowstring length. Thus, the position along jig bar 210 where yoke post bar 244 is locked into place by yoke post bar lock 247 relative to the position of tensioner assembly 220 and tensioner post 224 will determine the final string length.

It should be noted, as shown in FIG. 11, that serving winding apparatus 230 is also positionable along jig bar 210, and may be locked in a chosen position by utilizing one or more winding head locks 232. In addition, winding apparatus power head 250 is positionable in either a stowed position, as shown in FIGS. 11 and 12, or alternatively pivoted in relation to winding apparatus base 252 about drive shaft 254, and locked into place by winding apparatus head lock pin 256 (See FIG. 13). Although such would be hidden in FIGS. 11-12, a detent formed as part of winding power head 250 can be engaged by lock pin 256 to prevent accidental movement of power head 250 into the work space while wrapping of bowstring body fiber is carried out. Thus, while bowstring body fiber is wrapped around wrapping posts 224 and 242 (i.e. pins 248, 249), the winding apparatus head 250 is stowed, and does not interfere with wrapping the loops of bowstring fiber. As will be seen, when utilized in the application of serving fiber to the bowstring body fiber, the winding apparatus head is raised into the winding or drive position.

Turning now to FIG. 13, a further perspective view of a bowstring jig 200 utilizing the powered serving winder apparatus 230 of the invention is shown with nascent bowstring 260 positioned so that the body fiber may be served using the apparatus. Winding power head 250 has been pivoted in relation to winding apparatus base 252 about drive shaft 254, and locked into place for active winding by winding apparatus head lock pin 256 being seated in a detent formed in the side of power head 250. Detent 258, that functions to lock power head 250 into the stowed position, is now revealed by the pivoting of power head 250. (See FIG. 12). Bowstring body fiber 204 has been removed from wrapping post pins 248 and 249, fed through winding apparatus power head 250, and then again hooked over pin 248. Winding yoke 240 may be repositioned, and pivoted about pivot 246 by actuating lock 247 while such movement is accomplished. Bowstring body fiber loops, now close and reappear as linear bowstring 260. Bowstring 260 is tensioned by initial positioning of tensioner post 224 and pin 248 relative to one another, and then further placed under tension by the action of tensioner assembly 220, through tensioner post 224 and tensioner adjuster 228. Bowstring 260 passes through a passage 237 in guide shaft 236. On opposed ends of guide shaft 236 serving tool adapters 234 and 235 are mounted, said heads also having a coaxial passage, here shown with a Cavalier-type serving tool 239 engaged on serving tool guides 234. Power is applied to drive shaft 254, (by, for instance, an electric motor, or portable drill) rotating guide shaft 236. As guide shaft 236 rotates, serving tool 239 is wrapped around the bowstring 260, winding serving cord around the bowstring body fiber. Thus the apparatus both powers the rotation of the serving tool, and allows the tool to advance or index along the bowstring due to the wrapping action of the serving.

As shown in FIGS. 11-12 serving winder apparatus 230 can be positioned at any location along jig bar 210, and has a pair of opposed serving heads, i.e. serving tool adapters. This is an advantage over other known powerable serving winders because it allows loop serving to be applied to both ends of the bowstring, and nock serving to be applied to the middle of the bowstring in a simple operation. Thus the user is not forced to repetitiously remove and remount and or reposition the string under construction on the jig, or the serving apparatus in order to utilize the powered aspects of the serving winder apparatus.

Thus, in one embodiment of the invention the serving winder apparatus is positioned along the bowstring body 260, and serving tool 239 is positioned on serving tool guides 270 at the distal end 272 of serving tool guides 242. As power is applied to rotate guide shaft 236, serving is wrapped around the bowstring body, and serving tool 239 advances, i.e. indexes, along the bowstring 260 and serving tool guides 270. It is desirable that the indexing of the point of contact of the serving cord with the nascent bowstring be adjacent but not overlapping the immediately previously applied turn of serving cord. As shown in FIG. 6, it is desirable that successive turns of serving cord lay in a uniform layer, with such uniformity accomplished by the indexing of the point of application of the serving cord by the apparatus. When serving is complete, or the serving tool reaches the proximal end 274 of serving tool guides 270, for instance, the apparatus is stopped, and one or both of the guide shaft or serving apparatus itself are repositioned to continue applying serving to other areas of the bowstring. As shown in FIGS. 11-13, each serving tool adapter as at 234, 235 is embodied with four detachable serving tool guides 270. It is apparent that the relative size positions of such guides are subject to the requirements of a particular serving tool or serving cord supply that is being utilized with the apparatus.

Figure 14:
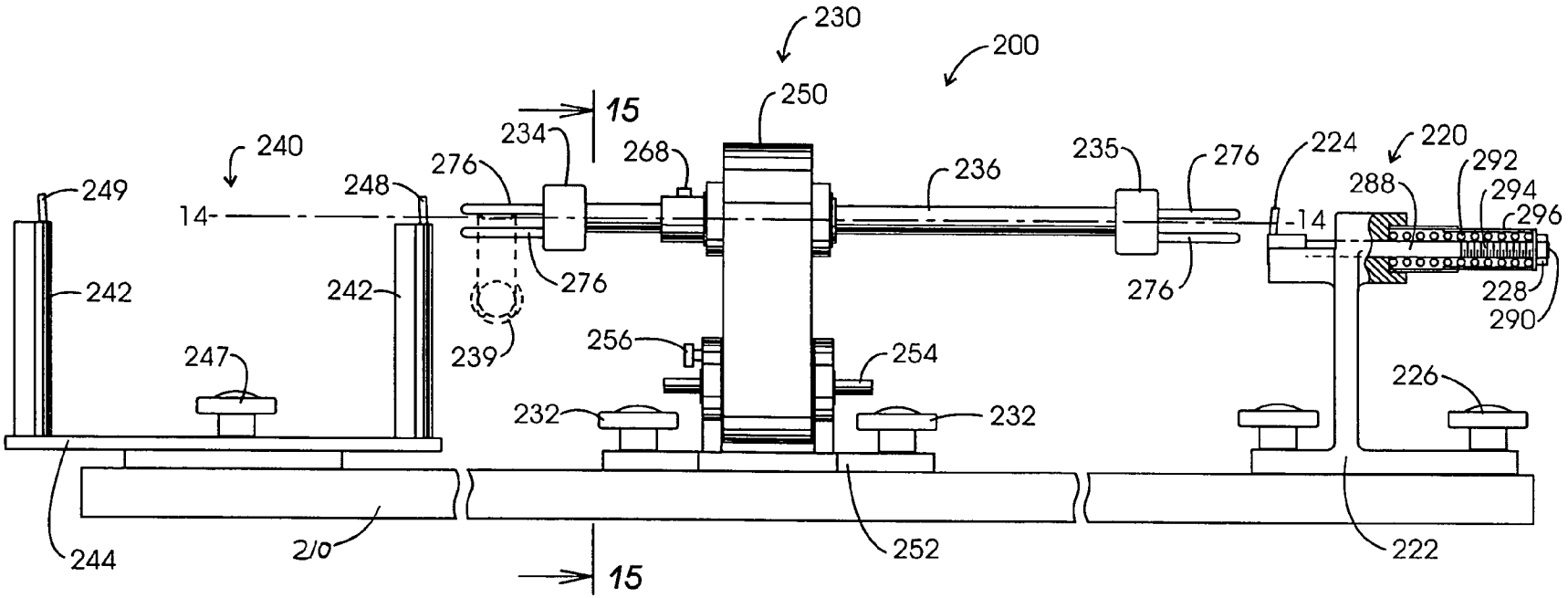
FIG. 14 shows a front view of the bowstring jig apparatus, a power head with an extended guide shaft and a partial longitudinal cross section of a jig tensioner.
Figure 15:
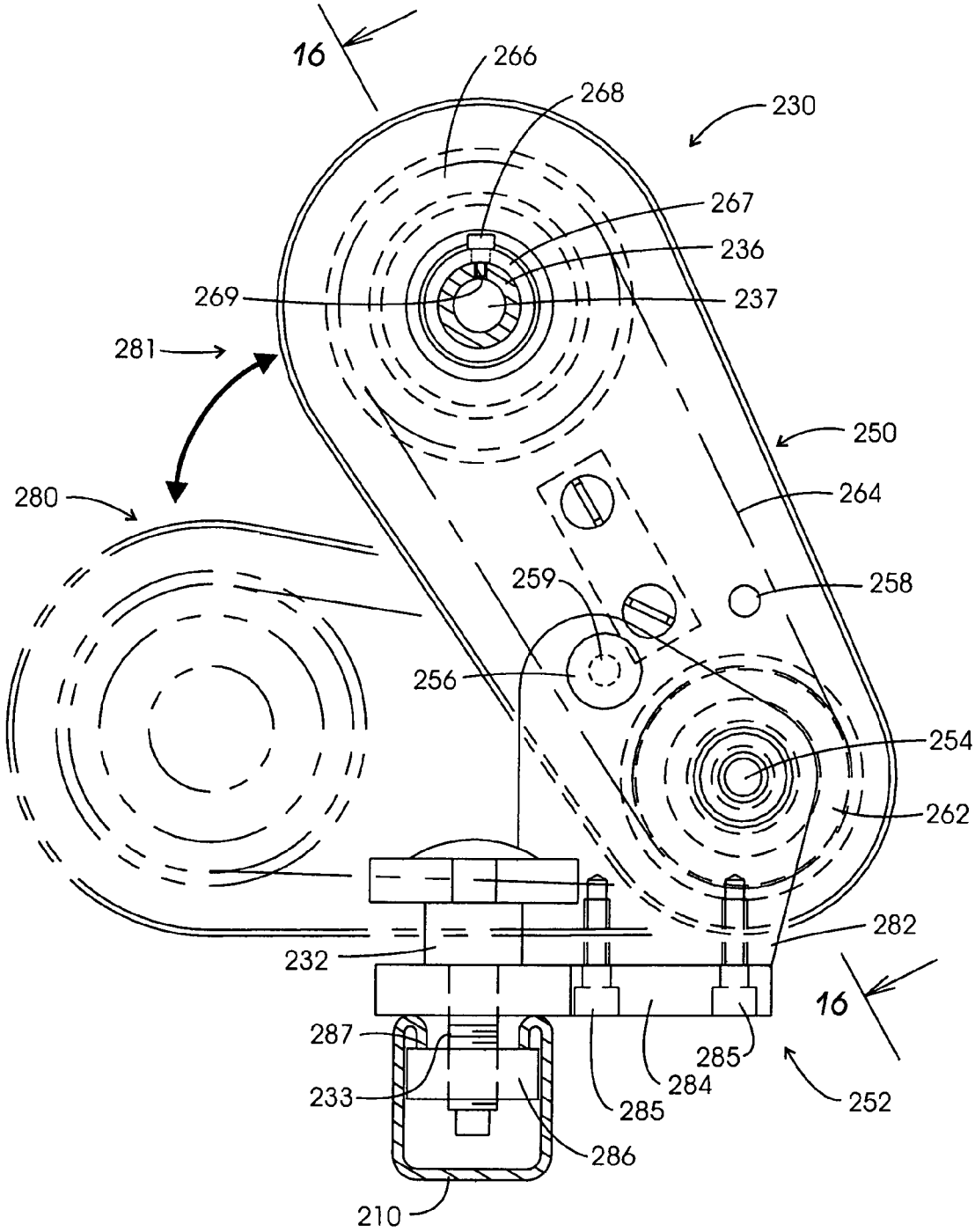
FIG. 15 shows an end view of the jig apparatus and the serving winder therefrom

FIG. 14 shows a front view and partial cross section of the apparatus 200, and FIG. 15 shows a detail view from plane 15-15 of FIG. 14 of the construction of the serving winder 230. The apparatus shown in FIGS. 14 and 15 is but one embodiment of the invention, and is similar to the apparatus shown in FIG. 11-13. In FIG. 14, tensioner 220, serving winder 230 and yoke 240 are positioned along jig bar 210 to allow bowstring body material (as at 204 in FIG. 11) to be threaded through hollow guide shaft 236, and a serving tool is mounted on serving tool guides 276 of serving tool adapter 234 or 235.

An advantage of the present invention is the provision for applying tension by means of tensioner 220 to the bowstring body while the serving material is applied to the bowstring body. Such tension may be optionally provided in a predetermined manner, in a constant tension, or with increasing tension while serving is proceeding. Tensioner assembly 220, as shown in partial cross section in FIG. 14, is supported by tensioner body 222, with tensioner body 222 having a hollow passage 288 occupied by tensioner rod 290. Tension is applied to any bowstring fixed to tensioner post 224 through tensioner rod 290 and the action by spring 292, or other means to resiliently apply resistive force to tensioner rod 290, with such tension being transmitted to tensioner post 224. In one embodiment tensioner rod 290 is threaded at tensioner rod threads 294, and tension can be applied and regulated to a bowstring attached to tensioner post 224 by compressing tensioner spring 292 through the action of tightening tensioner nut 228. As shown in FIG. 14, spring 292 and nut 228 bear against telescoping case 296, which is seated in tensioner body 222. Alternative embodiments of said tensioner assembly are envisioned, wherein tension and or resistive force are supplied through the action of the tensioner 220 against tensioner post 224. Such force may be applied by means of hydraulics, air pressure, electrically or other means. Tensioner 220 may optionally be provided with capability of presetting tension, measuring applied tension or audibly or otherwise indicating the amount of force being applied.

Guide shaft 236, as shown in FIG. 14, is embodied with an extended length, that allows easy positioning of the serving tool adapters 234 and 235 at chosen locations along a bowstring mounted between posts 224 and 248 by lateral, longitudinal, movement of the guide shaft through the idler shaft. In alternative embodiments, guide shaft 236 is shorter relative to serving tool guides 276.

FIG. 14 demonstrates the positioning of guide shaft 236, serving tool adapters 234, 235 and pins 224, 248, 249 in relation to axis 14-14. Thus when a bowstring is mounted on jig 200, as shown in FIG. 13, said bowstring lies along axis 14-14, and when serving cord is wound around the bowstring through the effect of the rotational action of shaft 236 rotating a serving cord supply about axis 14-14 said serving cord is deposited coaxially with the bowstring body fiber and axis 14-14. The coaxial nature of the serving winder allows for application of end serving, cam serving, and nock serving or other intermediate serving without removing the bowstring from the jig apparatus. As rotational power is applied to drive shaft 254, serving winder 230 transmits rotational power to rotate guide shaft 236, with said guide shaft rotating serving adapter 234, for instance, and thus wrapping serving cord from a provided serving cord supply around the bowstring body fiber. Bowstring body fiber is held in an essentially stationary position between posts 224 and 248, and when tension is applied to bowstring body fibers, said tension may be maintained through the action of tensioner 220. The embodiment shown provides an efficient and robust system and apparatus for rapid manufacturing of bowstrings, and bowstrings made using the new apparatus and method are such that when desired properties are achieved, such bowstrings may be reliably reproduced in other manufacturing operations by taking note of the manufacturing parameters utilized when a bowstring is manufactured utilizing the disclosed apparatus.

FIG. 15 is an end view from plane 15-15 of FIG. 14 of serving winder 230 mounted on the jig apparatus. Rotational power is supplied to drive shaft 254, for instance, by a detachable reversible variable speed electric drill, a cordless drill, by an integrally attached electric motor, an integrally attached motor or an electric drill under the control of a foot pedal switch or by other available power source. Drive pulley 262 is keyed to drive shaft 254, driving, for instance, a driving belt 264, which in turn powers idler pulley 266 and idler shaft 267. Guide shaft 236 is slidably keyed to idler shaft 267 by guide shaft lock 268, allowing the guide shaft to index longitudinally through guide shaft slot 269 along axis 14-14. Passage 237, which can accommodate passage of a bowstring, is revealed at the exposed end of guide shaft 236. Referring briefly to FIG. 14, passage 237 is positionable so that it is coaxial with axis 14-14.

FIG. 15 demonstrates an additional feature of the invention that the power head 250 can be engaged in a stowed position, as shown in phantom in FIG. 15 at 280, or in a drive position, as shown in position 281. Power head 250 pivots about drive shaft 254 that passes through pivot plate 282. Engagement lock 256 holds the power head in either the drive or stowed position, by engaging detents such as 258 and 259, formed in the side of the power head body. Thus power head 250 of serving winder apparatus 230 is positionable in a number of alternative positions at the option of the user. While a preferred embodiment provides two such positions, additional positions are available, and such could be provided by addition of more intermediate detents as at 258, or at an infinite number of positions along an arc traversed by winder head 250 relative to pivot plate 282. A preferred position for winder head 250 is such that winder head 250 is held in position such that passage 237 is coaxial with bowstring body fiber mounted on the assembled jig apparatus.

Base plate 284 of winder base 252 is typically attached to pivot plate 282 and 283 (see FIG. 16) by means of fasteners 285, although in another embodiment, base plate 284 and pivot plates could be cast or machined as a single structure. Winder hold down 232 and threaded portion 233 along with base clamp 286 allows the serving winder apparatus to be clamped in position along jig bar 210, by latching against lip 287. A variety of alternative hold down structures are available, which are adaptable to a variety of supports for the apparatus as alternative embodiments to the lipped channel of jig bar 210.

Figure 16:
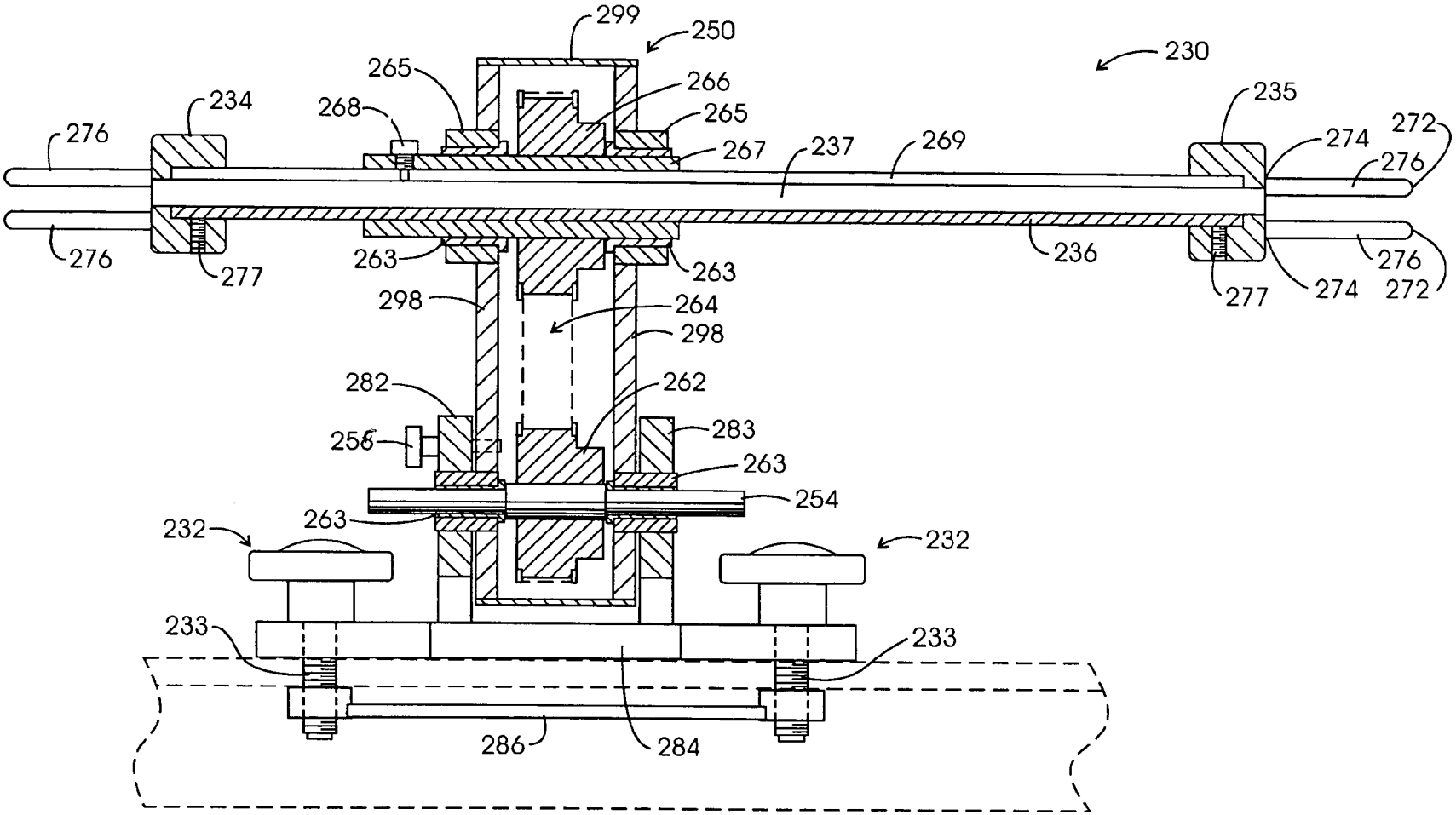
FIG. 16 shows a detailed longitudinal cross section of the serving winder shown in FIG. 15.

Turning now to FIG. 16, a cross section of the serving winder apparatus 230 shown in FIGS. 14 and 15 along line 16-16 of FIG. 15 is shown. Again, powered drive shaft 254 drives drive pulley 262 riding in bearings 263, which drives belt 264. As preferably embodied, belt 264 is a resilient belt, and can alternatively be one or more of a V-belt, a toothed belt, a cogged chain or a variety of other drive connections between drive pulley 262 and idler pulley 266. Belt 264 in turn powers idler pulley 266 along with idler shaft 267, idler shaft 267 riding in additional bearings 263, supported by collar 265. The components of winding power head 250 are carried within case 298 and enclosed by cover 299. Guide shaft 236 is shown slidably keyed to idler shaft 267 by guide shaft lock 268, the guide shaft lock capable traveling along guide shaft slot 269. As shown, guide shaft passage 237, extends through both ends of end of guide shaft 236.

It will be apparent that the circumference of the drive pulley and the idler pulley may be altered relative one another to achieve different rotational ratios of the two pulleys. It should also be noted that while a preferred embodiment of the invention utilizes pulleys adaptable for use with resilient V-belts common in low torque drive systems, the term pulley as used herein should not be limited to common V-belt pulleys. In fact the drive shaft is coupled to a drive pulley, with said drive pulley alternatively consisting of a toothed pulley, a gear or other structure commonly associated with transfer of rotational force. Compatible pulleys are alternative embodiments of the idler pulley. The connector belt, delivering rotational force to the idler pulley, is chosen based on the characteristics of the drive and idler pulleys. If the pulleys are embodied as gears, a gear chain would function as the connector "belt." It is considered that direct contact between drive and idler pulleys is equivalent to rotationally connecting said pulleys with a connector belt.

Serving heads 234 and 235, embodied in FIGS. 14-16 as adaptable for use with common serving tools, support serving tool guides 276. Serving tool heads 234 and 235 may be locked to guide shaft 236 through threaded set screw 277, by turning said set screws into an internally threaded passage tapped into the respective serving heads. As can be seen in FIG. 16, the distal ends 272 of serving tool guides 276 are beveled, and the serving tool guides extend for a distance to the guide proximal end that is seated in serving heads 234 or 235. As embodied in FIG. 16, winder power head 250 pivots about shaft 254, with, as shown left pivot plate 282 providing power head lock pin 258, and right pivot plate 283 supporting the other extension of shaft 254. In the embodiment shown, two winder hold downs 232 are provided, providing apparatus to lock base plate 284 in place along the jig, with in this embodiment, one base clamp 286 provides attaching points for two threaded portions 233.

Figure 17:
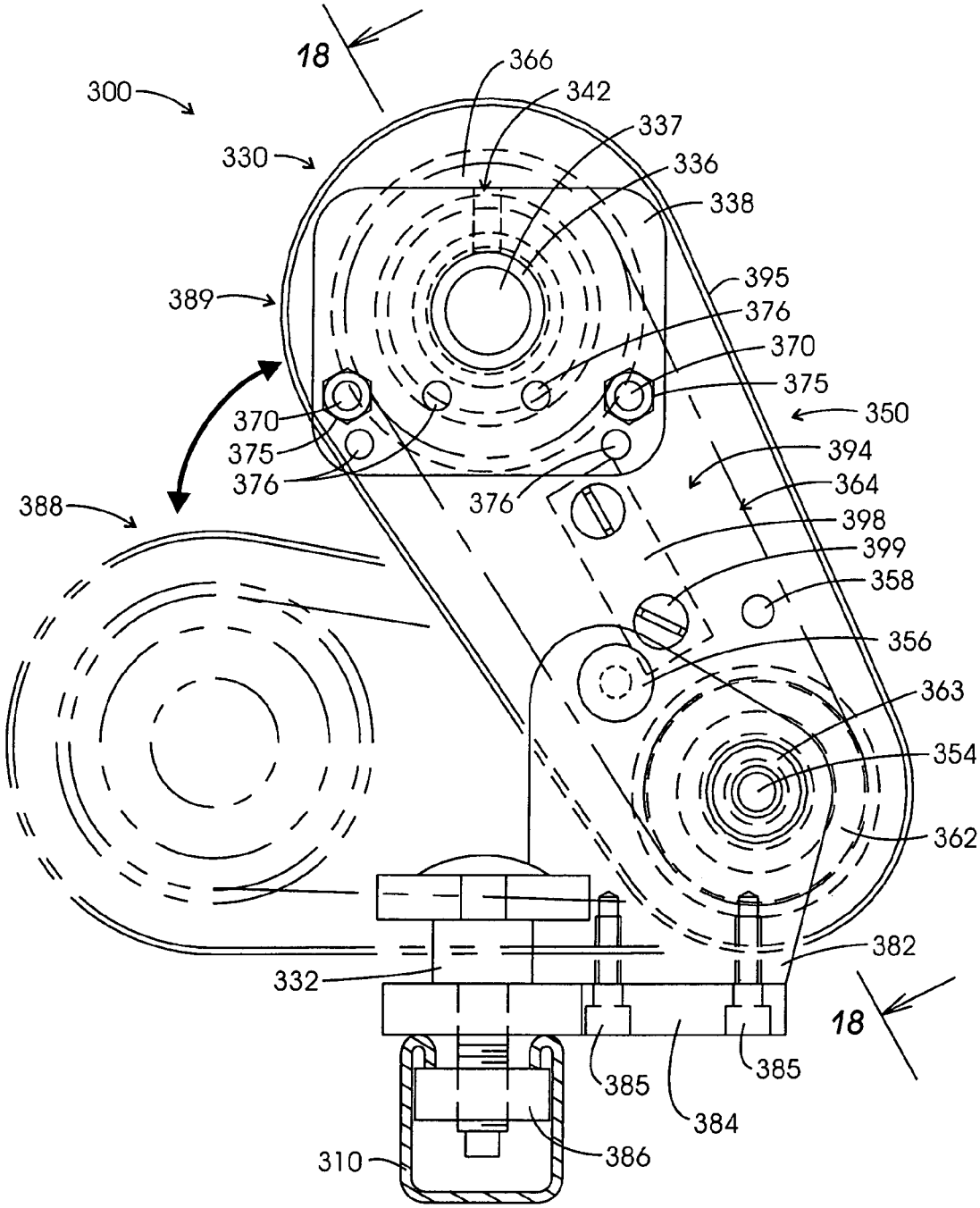
FIG. 17 shows an end view of an alternative embodiment of the bowstring jig apparatus.

Referring again to FIG. 11-13, it will be apparent that there are four serving head guides 270 mounted on serving head 234. The position of said guides is selectable by the user in order to utilize a variety of serving tools, such as tool 239, or other variations that are commercially available. The number of serving head guides is optionally one or more, preferably two or four guides. As seen in FIG. 17, mounting of serving head guides to the serving head is available by a number of means, including threaded, snap in or press fit. If such guides are threaded for insertion, it may be useful for such threaded guides to be threaded with a pitch opposite the intended rotation of the serving head, to maintain the seating of the guide in the head.

As shown in FIG. 11 and FIG. 14, serving head guides may be a smooth cylinder of approximately 2 to 6 inches long, which is a typical length of serving applied either to the end or intermediate positions of a bowstring. In other embodiments of the invention, the serving head guides may be threaded along their length, with a thread that approximated the desired pitch of the applied serving fiber. Thus, the pitch of the serving applied to a bowstring may be selected by selecting different threads on the serving head guides. A matched female threaded bracket may be employed to follow a particular male threaded serving head guide.

Figure 18:
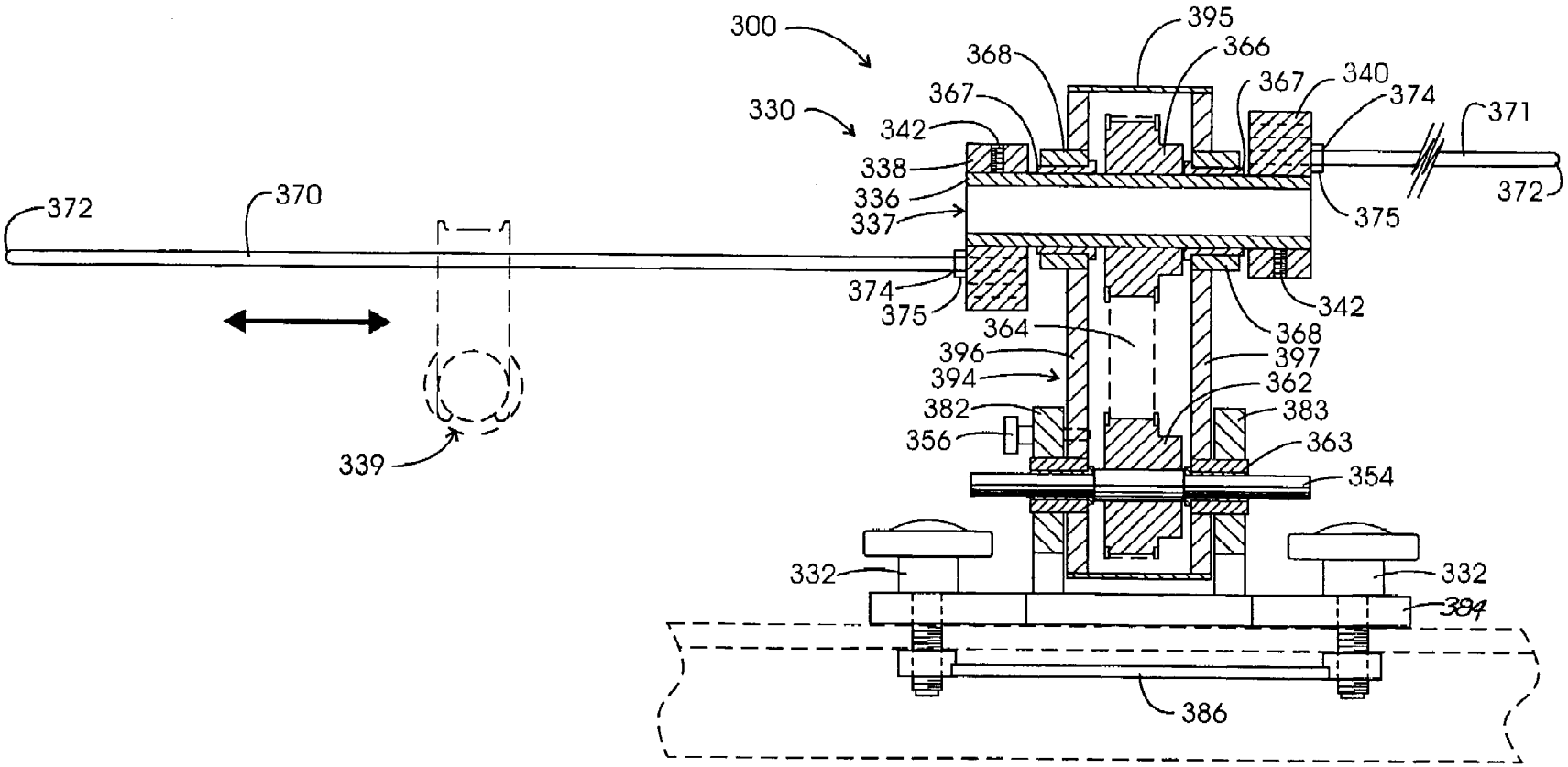
FIG. 18 shows a detail cross section of an alternative embodiment of the powered serving winder with extended guide rods as shown in FIG. 17.

An additional embodiment of the powered serving winder is shown in FIGS. 17-18. FIG. 17 shows a left end view of the bowstring jig 300, showing the new embodiment of powered serving winder 330, mounted on a jig bar 310. FIG. 18 shows a detail view of a longitudinal cross section along line 18-18 of the powered serving winder 330 of FIG. 17.

Bowstring body material is to be threaded through hollow guide shaft 336, (via passage 337), the guide shaft of to which serving tool heads 338 and 340 are mounted. Power is to be applied to drive shaft 354 by a chosen power source. Drive pulley 362 is engaged to drive shaft 354, with the drive shaft riding in bearing set 363, and driving belt 364, which in turn powers idler pulley 366 and guide shaft 336. Guide shaft 336 is in this embodiment of the invention engaged with pulley 366. The guide shaft is supported by inner bearing 367 and outer bearing 368. As previously described, base plate 384 is locked in position by threaded hold downs 332 along with base clamp 386 allowing the serving winder apparatus to be removeably clamped in position along jig bar 310. Fasteners as at 385 attach left pivot plate 382 and right pivot plate 383 to base plate 384.

FIG. 17 again demonstrates the embodiment of the invention providing that the power head 350 is alternatively positionable and can thus be engaged in a stowed position, as shown in phantom in FIG. 17 at 388, or in a drive position, as shown in position 389. Engagement lock 356 holds the power head in either the drive or stowed position, by engaging detents such as 358, formed in the side of the power head body case 394. Thus passage 337 is positionable so that it is coaxial with a longitudinal axis of bowstring body fiber mounted on the assembled jig apparatus. Power head 350 pivots about drive shaft 354 that passes through pivot plates 382 and 383.

The components of winding power head 350 are carried within case 394 and further enclosed by cover 395. Left case portion 396 and right case portion 397 are held in place by spacer block 398 and fasteners 399, said fasteners, for instance, tightening the two case portions together by engagement of threads on fasteners 399.

Serving heads 338 and 340, as embodied in FIGS. 17-18 are generally rectangular in plan and provide guides that provide for use with common serving tools, a serving cord bobbin, or other serving cord supply. Serving tool heads 338 and 340 may be locked to guide shaft 336 through threaded set screw 342, by turning said set screws into an internally threaded passage tapped into the respective serving heads. Serving heads, as at 338, function as an adapter for different serving tools and serving cord supplies.

A serving tool, 339, may be mounted on serving tool guides, such as on guides 370 of serving tool head 338 and guides 371 on serving head 340. The various serving tool guides are characterized by a distal end at 372 and a proximal end at 374. Guides are embodied as being removeably attachable, and further alternatively embodied as providing a lock, as a hex head 375. In one embodiment, the proximal end of guide 374 is externally threaded to mate with internal threads in mounting holes, as at 376, in head 339, for instance, with hex head 375 providing ready means to tighten the guide into the hole, locking it in place.

As the serving of a bowstring body fiber bundle progresses, and the power head rotates the serving heads, a serving tool as at 339 of FIG. 18, will index along the tool guides, typically from the distal end of the guide towards the proximal end, said direction depending in part of the orientation of the serving cord supply and the rotational direction of the guide shaft. A number of additional locations for engagement of serving tool guides as shown at 376 are provided to accommodate a variety of different forms of serving tools or other serving cord bobbins or cord supplies. Returning to FIG. 17, the end view of serving head 340 demonstrates the alternative positions available for mounting serving tool guides, such as guides 370. Said guides may be optionally mounted in one or more of guides holes 376, with two of said guide holes shown occupied by serving tool guides 370. Guide holes 376 in certain embodiments of the invention are threaded to allow reliable mounting of the serving tool guides, with the holes optionally threaded in opposition to the direction of travel of the serving heads. Other means of securely removeably mounting serving tool guides to serving tool head 338 and 340 will be apparent to those skilled in the art. The selectable positions of serving tool guides allows use of the invention with a variety of serving tools and other winding tools as may be desired by the user.

Indexing is defined for the purposes of this disclosure as the controlled longitudinal movement or displacement of component of the apparatus along the axis of the bowstring or cable being manufactured. It will be recognized by artisans that the serving spool in a preferred embodiment is self indexing. As such, the spiral winding of serving around the bowstring body functions to advance the serving spool along the serving head guides. In another embodiment, other means of indexing the serving spool may be employed, such as by means of a machined thread, movement of the serving drive apparatus along the jig base, or other means known to those skilled in the art. During the application of serving cord around a bundle of fibers, it is desirable that a single layer of cord is placed in sequence along a served bundle, i.e. cabling the individual fibers, for instance bowstring body fibers, into a stable structure. Referring briefly to FIG. 6, it is noted that serving cord 84 is placed in a single continuous strand along body fibers 74, essentially as a spiral about the axis of the body fibers. The pitch of this spiral may be varied in certain situations. Nonetheless, the placement of the single layer of serving cord as at 86 is a function of the longitudinal indexing of the serving cord along the body fibers that are served into a fixed bundle. As can be seen in FIG. 5, successive layers of serving cord can be applied to previous layers, as end serving 89 overlays loop serving 88. A prominent feature of the preferred embodiments is the indexing of the serving cord being applied as a serving cord supply is rotated about the axis of a bundle of bowstring body fibers. This self indexing is a accomplished by a combination of the rotation of the serving cord supply, the longitudinal travel of the serving cord supply, (typically embodied as a serving tool) relative to the body fibers, along the guide rods, or alternatively by the longitudinal movement of the guide shaft, or the serving winder head itself, and the tension on the serving cord being delivered. Thus a further embodiment in a serving winder that rotates a cord supply about the axis of a bundle of fibers that are essentially stationary, with the capability of the longitudinal travel of the serving cord supply while being rotated under power by the serving winder power head.

Figure 23:
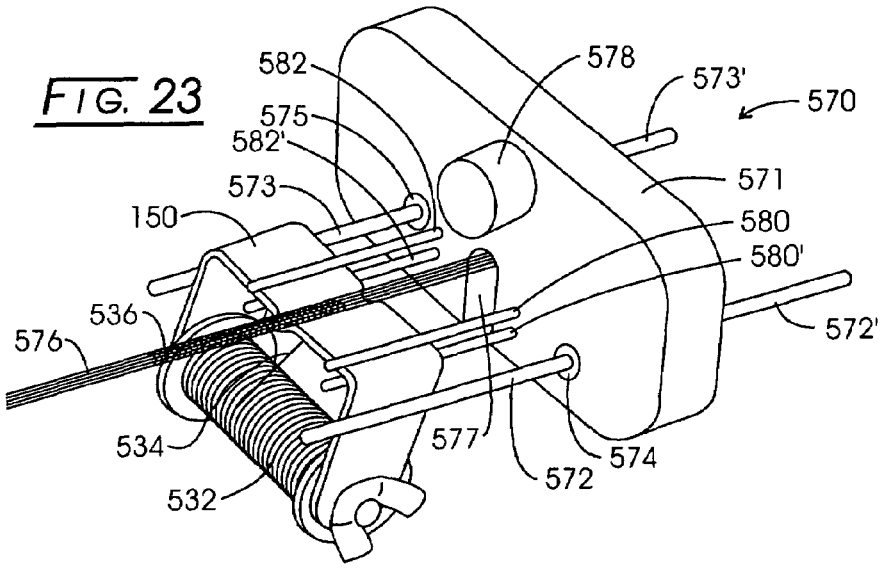
FIG. 23 shows a perspective view of a serving winder carriage.
Figure 24:
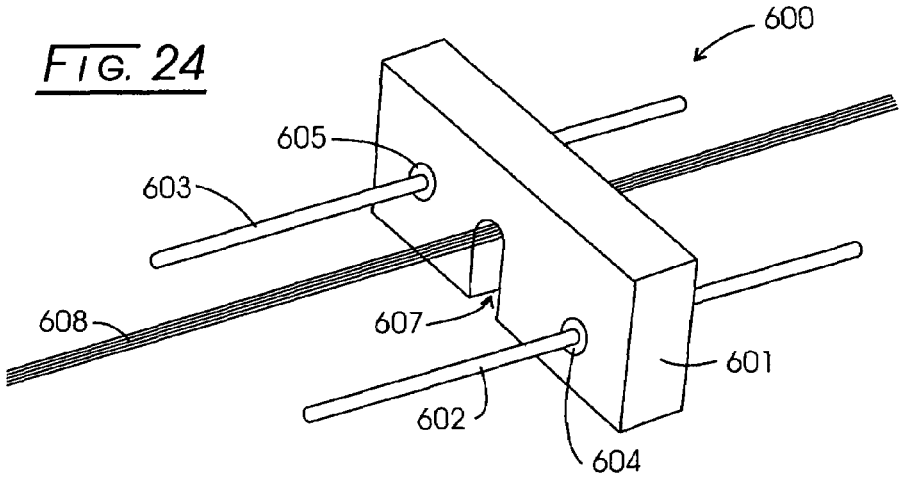
FIG. 24 shows a perspective view of a guide anti-spread bar.

Returning again to FIG. 18, the embodiment of the invention is shown wherein the serving tool indexing guides 370 and 371 are substantially extended, allowing serving to be applied for an extended portion of the bowstring body fiber, without utilizing optional repositioning of the serving winder head 330. Guides, for instance guide 371, are optionally removeable to allow the powered serving winder 330 to be positioned along jig bar 310 at a location that allows application of intermediate serving, without the guides interfering with the winding posts or tensioning head. Extended guides may be 4 inches, 8 inches, 12 inches, and 16 inches or more long. As will be discussed further in connection with FIG. 23-25, as the guides become longer, it is advantageous to employ components that maintain the rotation of the guides about the rotational axis.

Figure 20:
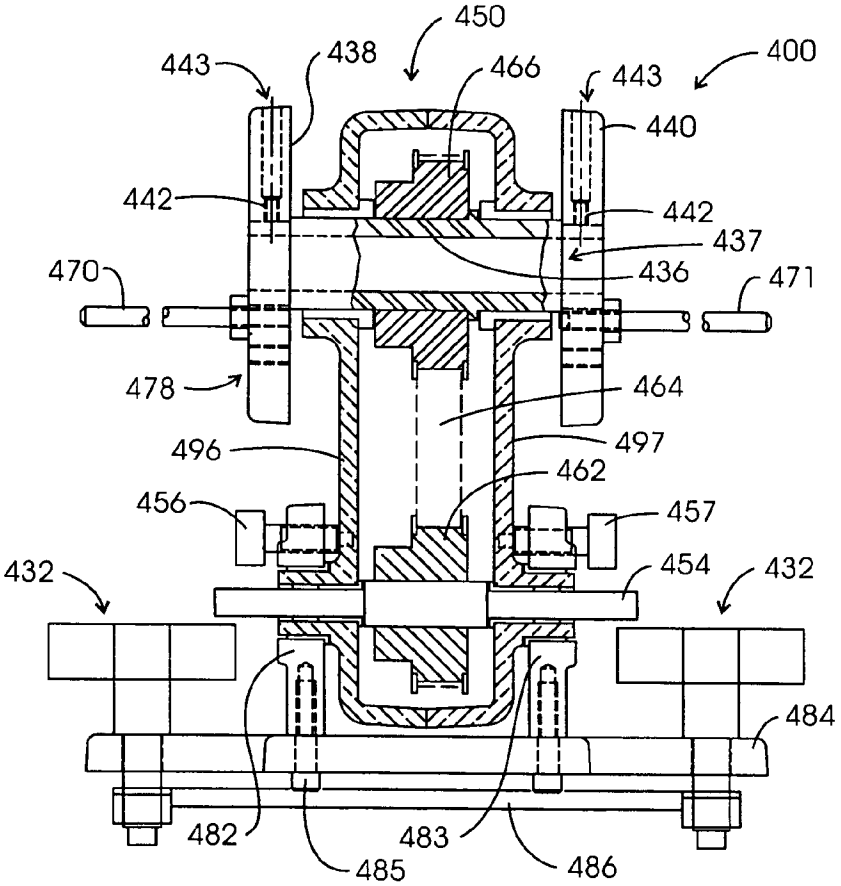
FIG. 20 shows a detail cross section of an alternative embodiment of the powered serving winder with disk shaped serving heads as shown in FIG. 19.
Figure 19:
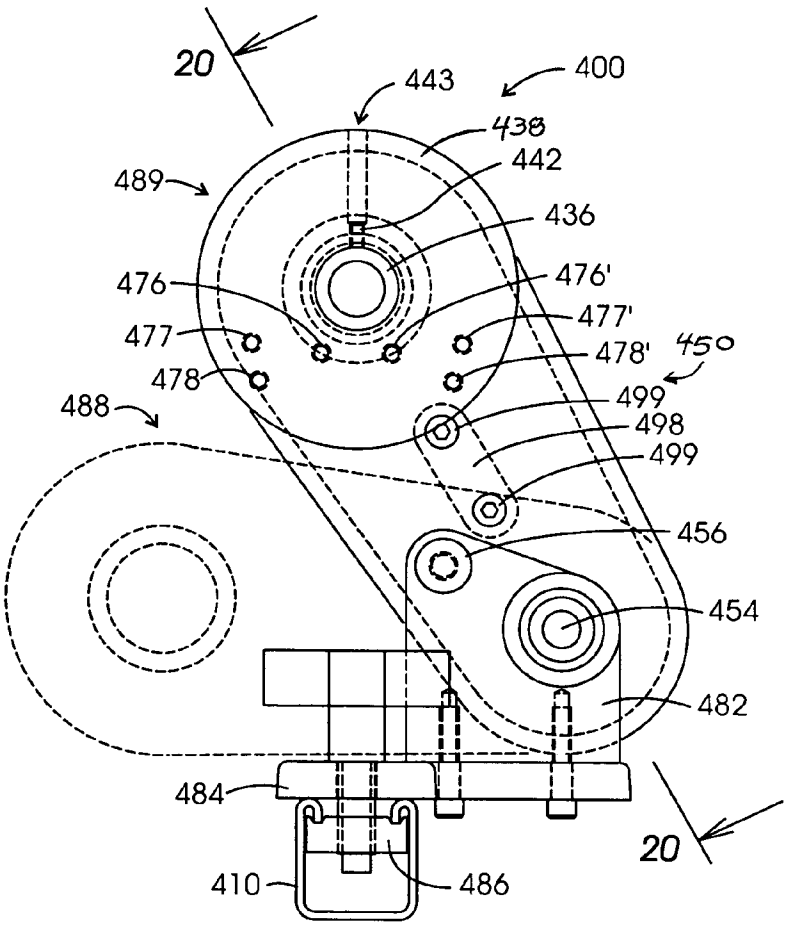
FIG. 19 shows an end view of an alternative embodiment of the powered serving winder and jig apparatus.

An additional embodiment of the serving winder is shown in FIGS. 19-20. FIG. 19 shows a left end view of the bowstring serving winder 480, mounted on jig bar 410. FIG. 20 shows a detail view of a longitudinal cross section along line 20-20 of the powered serving winder 430 of FIG. 19. Hollow guide shaft 436, (via passage 437), the ends to which serving tool heads 438 and 440 are mounted. Power is may be applied to drive shaft 454, rotating cogged drive pulley 462, and driving gear belt 464, which in turn powers cogged idler pulley 466 and guide shaft 436. Guide shaft 436 is in this embodiment of the invention engaged with pulley 466. Base plate 484 is lockable in position by threaded hold downs 432 along with base clamp 486 allowing the serving winder apparatus to be removeably clamped in position along jig bar 410. Fasteners 485 mount left pivot plate 482 and right pivot plate 483 to base plate 484. Power head 450 is alternatively positionable, engagable in a stowed position, as at 488, or in a drive position, as shown in position 489. Engagement locks 456 and 457 are provided to secure the power head in either the drive or stowed position, by engaging the side of the power head body case 496 and 497, respectively. The components of winding power head 450 are carried within Left case half 496 and right case half 497 and are held in place by spacer block 498 and fasteners 499, said fasteners, for instance, tightening the two case portions together by engagement of threads on fasteners 499. Left case half 496 and right case half 497, may be constructed of cast aluminum, or plastic, or of machined metals of types known to artisans.

Serving tool heads 438 and 440 may be locked to guide shaft 436 through pin or screw 442, driven into passage 443, into contact with guide shaft 436 to prevent lateral or rotational movement of the serving heads relative to the guide shaft. Serving heads 438 and 440, as embodied in FIGS. 19-20 are generally circular in plan as a disk shape, with such shape having certain advantages for balancing rotational forces. In conjunction with a fixed guide shaft (as opposed to an indexable guide shaft as shown in FIG. 16) relatively extended guides are typically provided, although a wide variety of guide lengths are useful. As shown in FIG. 19, with no guides shown in their mounted position, the end view of serving head 438 demonstrates alternative positions available for mounting serving tool guides. Said guides may be optionally mounted in one or more of guides holes 476-478 and 476'-478'. As is apparent, said guide holes are generally provided in pairs so that mounted guides will position the serving cord supply centered about the rotational axis of the winder, although such is not an absolute requirement, and different serving tools may require use of unpaired guide holes such as a combination of guides mounted in holes 477, 477' and 478. As shown in FIG. 20 guides 470 and 471 are mounted in guide holes at 476.

Figure 21:
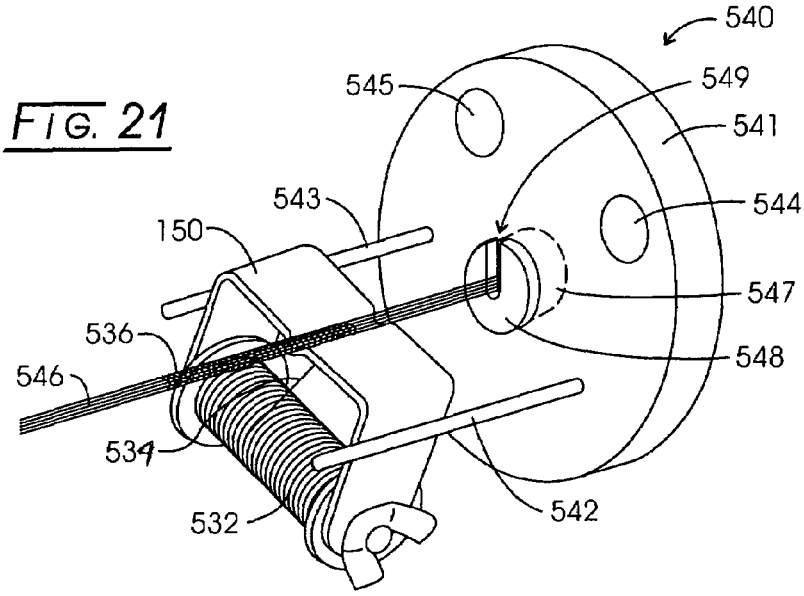
FIG. 21 shows a perspective view of a counterbalanced serving head assembly.

A variety of improvements of the disclosed embodiments of the serving heads are available that provide various benefits in the operation of the apparatus disclosed herein. As the apparatus provides a system for rotating a serving cord supply about an axis occupied by body fibers to be served into a bundle of cable, or locationally served as on a bowstring, as the rate of rotation of the serving heads is increased, and the length of the serving guides is increased, additional forces due to the rotating mass may need to be compensated for to maintain efficient operation of the apparatus. Turning now to FIG. 21, at 540 is shown a perspective view of serving head assembly, including serving head 541, embodied as a disk, serving guides 542 and 543, supporting serving tool 150, which provides a serving cord supply bobbin 532 and serving cord 534. As shown in FIG. 21, a served portion 536 of bowstring 546 is shown that has already been rotationally wrapped with serving cord. As the rate of rotation of the serving head assembly about the axis of the bowstring 546 increases, it become beneficial for the efficient operation of the serving head to counterbalance the rotational mass of the guide rods 542 and 543 and/or the serving tool 150. Thus, counterbalancing rod counter weights 544 and 545 are provided. In addition, the lateral forces applied to the bowstring by the contact with the serving tool and cord 534, along with centrifugal forces on the bowstring 546 itself, may, at high rotational speeds, lead to whipping of the bowstring, i.e. rotational deviation about the axis of rotation of the powered winder apparatus. Passage 547, through the face of serving head, normally accommodates the passage and rotation of the bowstring. Thus, serving heads are configured with such a passage, whether as an open slot or as a cavity passing through the serving head. By installation of slotted whip damping plug 548, the whipping action of the bowstring under rotational forces of the serving operation are minimized. Damping plug 548 may be removeably installed by passing the bowstring into slot 549, and then inserting damping plug 548 into serving head passage 547, where the plug is seated, typically through a press fit.

Figure 22:
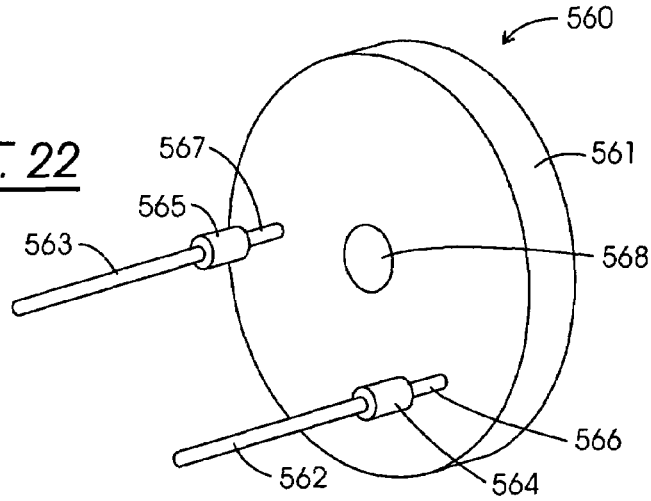
FIG. 22 shows a perspective view of a serving head assembly graphite serving guides adaptors.

The guide rods used in conjunction with the serving winder apparatus are adaptable to being constructed from a variety of materials, including, for instance, steel, aluminum, machined aluminum, plastic and composite materials such as graphite or fiberglass materials. Looking to FIG. 22, at 560 is shown a perspective view of a serving head assembly, including serving head 561, embodied as a disk, and graphite serving guides 562 and 563. To facilitate ease of mounting graphite serving guides as at 562 and 563, guide connectors are preferred, for instance, a knurled metallic adaptor connector 564 and 565 is affixed to the proximal ends of the respective guide rods, with head connectors 566 and 567 providing an attachment means to the serving head, for instance by a spring loaded twist lock arrangement. Passage 568 is also shown.

As shown in FIG. 17-18, for instance, the serving head assembly provides for the mounting of a serving tool directly to the guide rods installed on the serving head. A further embodiment of the winder apparatus employs a captive winder carriage that supports the serving tool. A perspective view of a serving winder carriage is shown at 570 in FIG. 23. Slidable carriage 571 can be installed over the guide rod distal ends 572 and 573 with the guide rods riding in linear guide rod bushings 574 and 575. Bowstring 576 passes to the axial center of the winder carriage though string slot 577. The rotational mass of serving tool 150 is counterbalanced by serving tool counterbalance 578, while cord supply 532 provides cord 534 which upon rotation of the serving winder apparatus applies serving at 536. Serving tool 150 is supported by attachment pins 580 and 582 in conjunction with optional pins or clips 580' and 582'. As has been previously described the position of pins 580 and 582 are selectable and dependable on the design of the serving tool or serving cord supply. As the serving winder is rotated by the serving head, where the guide rods are installed as previously described, the winder carriage travels longitudinally along the guide rods and relative to the bowstring, such that the winder carriage 570 is disposed away from guide rod distal ends 572 and 573 towards guide rod proximal ends 572' and 573' along the guide rods.

Figure 25:
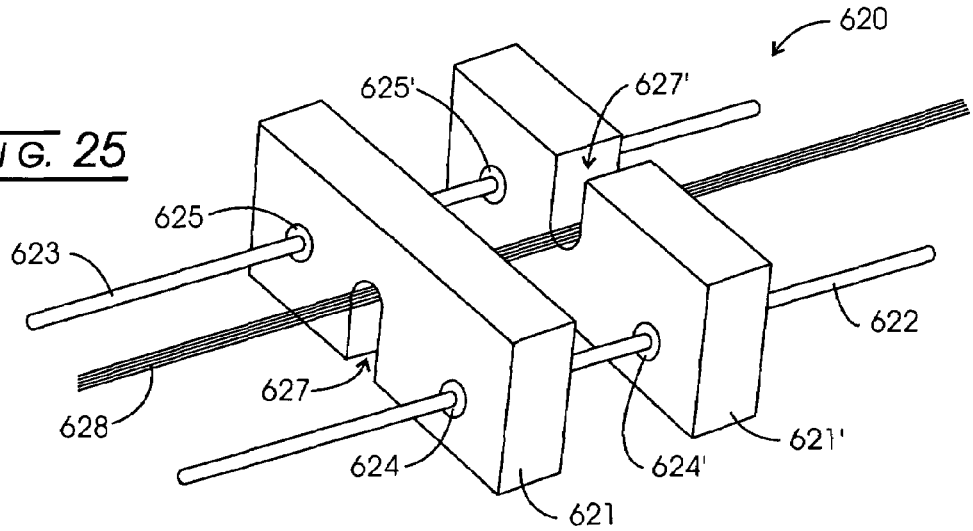
FIG. 25 shows a perspective view of an alternative embodiment of a guide anti-spread bar.

When longitudinally extended guide rods are used as shown at 370 and 371 of FIG. 18, for instance, as the rod length is extended, additional unsupported rotational mass is introduced. Such mass can become appreciable with heavier and ductile materials, such as aluminum are used, or when the diameter of the guide rods is minimized. In such situation as desired, a further embodiment of the winder apparatus may be employed wherein a guide anti-spread bar can be used to limit this effect. The centrifugal displacement of the distal end of the guide rods during rapid rotation is moderated by installation of one or more anti-spread bars. A perspective view of a guide anti-spread bar is shown at 600 in FIG. 24. Slidable anti-spread bar 601 can be placed over the distal ends of guide rods 602 and 603, where bushings 604 and 605 can optionally provide a sliding or press fit. String slot 607 provides for passage of bowstring 608, allowing the bowstring to pass through the axial center of the winder without appreciable deflection. Yet another embodiment is shown in FIG. 25, as a perspective view of a guide anti-spread bar assembly 620. A pair of slidable anti-spread bars at 621 and 621' are installed over the distal ends of guide rods 622 and 623, where bushings 624, 624', 625 and 625' can optionally be provided with a pressable fit. String slots 627 and 627' provide for passage of bowstring 628, allowing the bowstring to pass through the axial center of the winder without appreciable deflection. As shown the anti-spread bars are installed in opposite orientation relative to one another, thus provided an enclosed passage for bowstring 628, minimizing wander of the bowstring from the axial center during rotation of the serving heads and guide rods. Though shown as a rectangle in plan view in FIGS. 24 and 25, anti-spread bars can be provided in a variety of useful, balanceable plans, such as oval, or circular.

Figure 26:
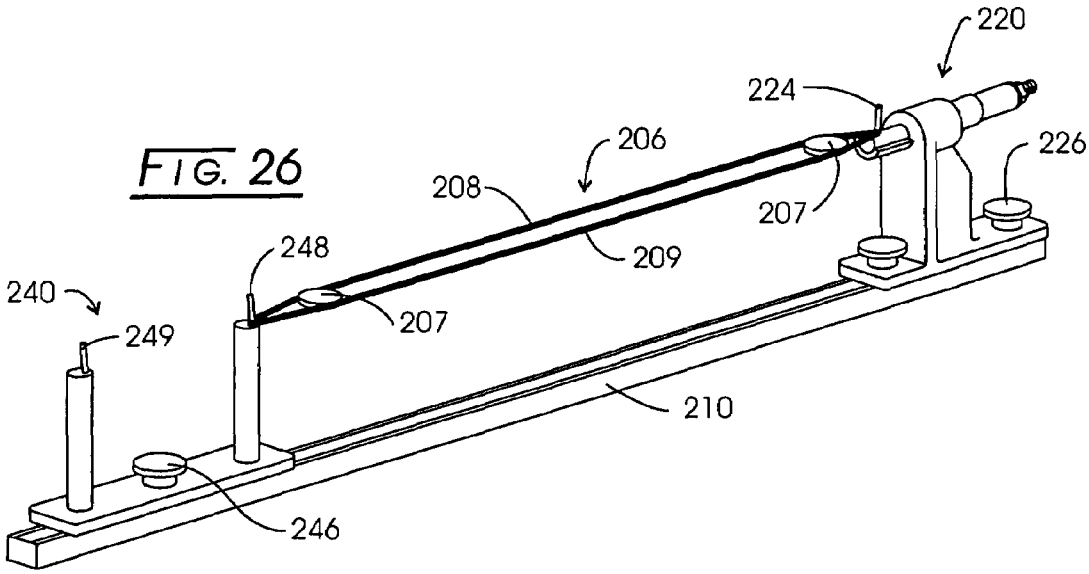
FIG. 26 shows a perspective view of a jig apparatus and bowstring with bundle spreaders.

The jig apparatus as shown in FIGS. 11-13 may be utilized without the serving winder apparatus 230. As shown in a perspective view in FIG. 25, such simplified apparatus 190 comprises a jig bar 210, with a slideable tensioner assembly 220 and slidable, rotatable winding yoke 240. The tensioner assembly may be repositioned by use of tensioner hold downs 226, and the winding yoke may be rotated and or repositioned along the jig bar by loosening and retightening yoke hold down 246. As a bowstring is to be constructed and body fiber is wrapped around posts 224, 248, and 249, end serving may first be applied using a manual serving tool to a portion of the bowstring body fiber, such as would be strung between posts 248 and 249 (see FIG. 12). The bundled fiber could then be repositioned so the end serving was at post 224, and the other end serving could be applied intermediately between posts 24 and 249. Thus a continuous loop of bowstring body fiber is initially fixed. The nascent bowstring 206 is repositioned to post 248, as shown in FIG. 26, and the finished length of the string is determined by positioning post 248 relative to post 224.

Prior to applying intermediate serving and or loop serving, the bowstring fibers may be twisted upon themselves to produce desired performance characteristics. Bowstring separators 207, formed as disks with a notch around their periphery, are placed near the winding posts to separate bowstring portion 208 from bowstring portion 209. Tension may be released from the tensioner assembly, and the tensioner shaft allowed to rotate freely within the tensioner body passage. With the bowstring separators in place, the bowstring may be preloaded with tension by shifting the tensioner assembly, and the tensioner shaft rotated to introduce a twist into the string prior to serving application the bowstring separators, in conjunction with the tensioner assembly, allow a uniform twist to be place in the bowstring body fiber bundle. Thus as a twist is applied to bowstring 206, the location of the twists can be readily controlled. As shown in FIG. 26, the tension applied to the nascent bowstring 206 may be regulated through use of tensioner assembly 220, again providing control over the performance characteristics of the finished bowstring. As is apparent from the features of jig apparatus 190, such jig possesses a new and useful combination of features that provide advantages over existing jigs. When this jig apparatus is used in conjunction with the disclosed serving winder, these advantages can be further implemented to produce high quality, reproducibly uniform bowstrings on a compact, portable and easy to use apparatus.

Figure 27:
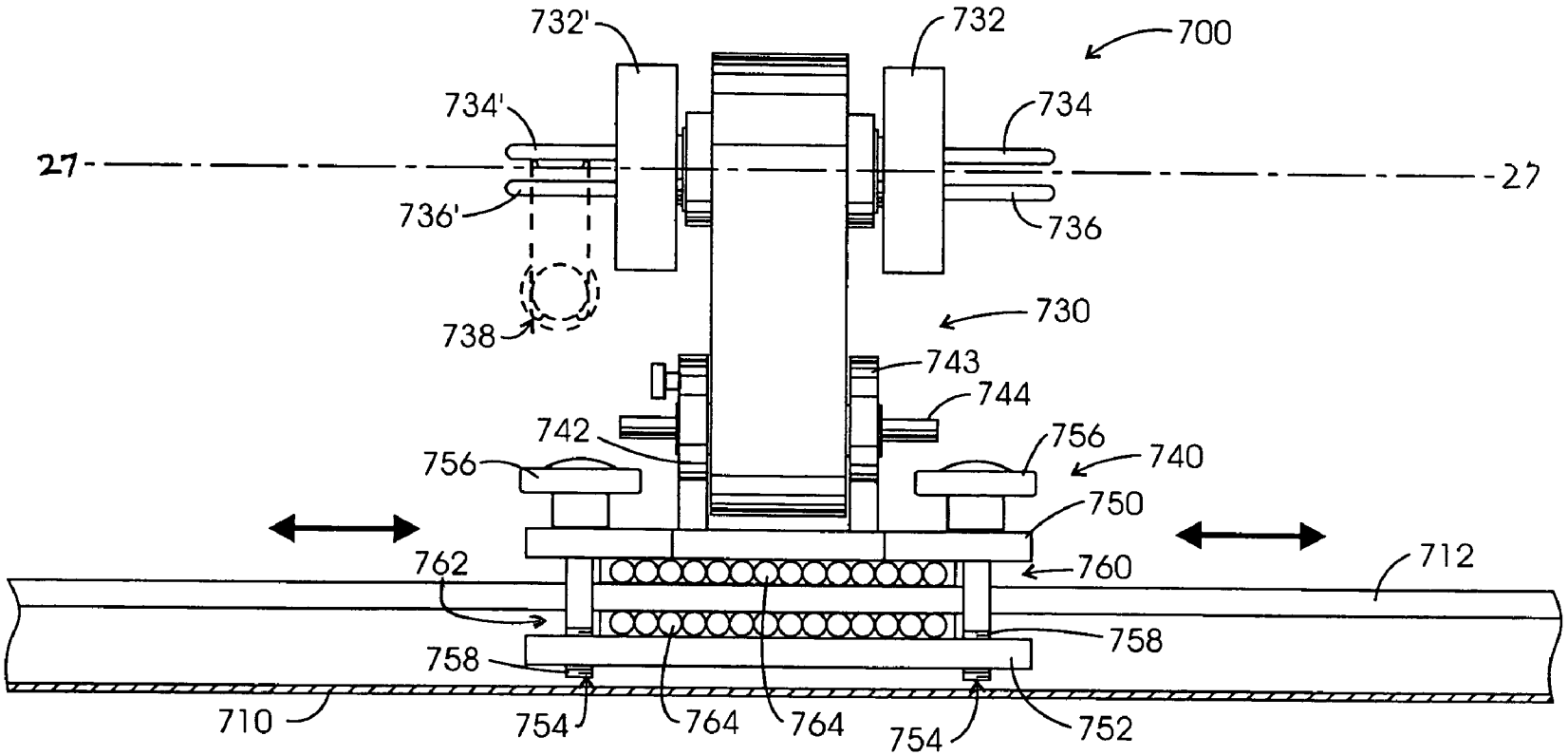
FIG. 27 shows an alternative embodiment of a slidable serving winder.

A prominent feature of the new apparatus is the provision for indexing of the wrapping of serving cord about a bundle of bowstring body fiber. A front view of an additional embodiment of the powered serving winder is shown in FIG. 27, which is further variation of the serving winder disclosed in connection with FIGS. 19-20. serving power head 730 of serving winder assembly 700 rotates serving heads 732 and 732' upon application of rotational power to drive shaft 744. The winder head 730 is pivotable about pivot plates 742 and 743. Serving head guides 734, 736, and 734' and 736' are embodied as relatively short guides, which can rotate a serving tool as at 738 about axis 27-27.

Where in other embodiments of the apparatus, lateral indexing of the wound serving was accomplished by longitudinal traverse of the serving spool along guide rods, as in FIG. 18, or by longitudinal traverse by a slidable guide shaft, as in FIG. 14, serving winder assembly 700 is constructed with a winder base assembly 740, comprised of top plate 750, top bearings 760, bottom bearings 762 and bottom plate 752. The top plate, bearings, and bottom plate are adjustably clamped together through internally threaded openings 754 in bottom plate 752 accepting clamps 756, wherein threaded portion 758 mates with the threads of bottom plate 754. Bearings 760 and 762 are adaptable to typical structures which would allow ease of traverse of the winding assembly 700 along jig bar 710, and are shown in FIG. 27 as rollers 764. Clamping of the two bearing sets allows onto lip 712 of jig bar 710, provides for the longitudinal traverse of the winder assembly along the jig bar in response to the longitudinal forces created by the rotation of the serving heads as they deposit wound serving cord along axis 27-27. Thus, assembly 700 embodies important novel features of the apparatus, allowing the application of serving cord to a number of positions along a fixed bowstring, without removal of the bowstring from the jig, providing two rotating serving heads, which are useful for applying serving to a bundle of bowstring body fibers held under tension in the jig apparatus.

While the invention has been described with reference to various embodiments, those skilled in the art will understand that various changes may be made and equivalents may be substituted for elements thereof without departing from the scope and essence of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. An apparatus for the manufacture of bowstrings comprising a bowstring jig for mounting bowstring body fiber;

a serving head for mounting a serving cord supply spool allowing positioning of the serving cord supply spool carrying serving cord in a coaxial manner with an extended axis of the bowstring body fiber mounted on the bowstring jig;

a coaxial, rotatable, pivotable, serving winder coupled to a drive system for rotating the serving head about the extended axis of the bowstring body fiber;

wherein the serving winder may be pivoted from a stowed position into an drive position, and while rotating the serving head about the extended axis of the bowstring body fiber, draws serving cord from the serving cord spool, wrapping serving cord about the extended axis of the bowstring body fiber, said serving winder indexing the serving cord along the extended axis of the bowstring body fiber while rotating the serving cord about said axis.

2. The apparatus of claim 1 wherein longitudinal displacement of the serving cord supply during wrapping and indexing of the serving cord of the serving cord supply spool is one or more of along an indexable hollow guide shaft relative to a winder head, along serving head guide rods, a serving winder base relative to a support system and a serving winder carriage relative to serving head guide rods.

3. The serving winder of claim 1 wherein the serving winder has two opposed serving heads.

4. The apparatus of claim 1 further comprising one or more of a jig bar, a winding yoke and a tensioner assembly.

5. The apparatus of claim 4 wherein the tensioner assembly further comprises a tensioner body, a threaded tensioner rod supported by the tensioner body, a winding post on one end of the tensioner rod, a spring bearing against the tensioner body and a tensioner nut threaded on the threaded tensioner rod, such that resistive force is supplied to the winding post.

6. The apparatus of claim 1 wherein the serving heads provide locations for mounting of one or more guide rods.

7. The serving winder drive system of claim 1 further comprising a drive shaft coupled to a drive pulley, a connector belt, delivering rotational force to an idler pulley coupled to a guide shaft, said guide shaft supporting the serving heads.

8. The serving winder drive system of claim 7 wherein the serving winder is pivotable about said drive shaft from a stowed to a drive position.

9. A bowstring manufactured using the apparatus of claim 1.

10. A bowstring jig comprising a wrapping yoke with two or more wrapping posts disposed along a post bar, said post bar positionable along a jig bar and lockable by a post bar lock;

an adjustable tensioner assembly providing for application of uniform tension to a tensioner post, said tensioner assembly being positionable along a jig bar and lockable by a tensioner lock;

such that bowstring body fiber may be wrapped around the wrapping posts and the tensioner post and tension may be applied to said bowstring body fiber while a bowstring is under construction on the jig.

11. The bowstring jig of claim 10 wherein the tensioner assembly further comprises a tensioner body, a threaded tensioner rod supported by the tensioner body, a tensioner post on one end of the tensioner rod, a spring bearing against the tensioner body and a tensioner nut threaded on the threaded tensioner rod, such that resistive force is supplied to the tensioner post.

* * * * *